US007194841B2

(12) United States Patent
Shima et al.

(10) Patent No.: US 7,194,841 B2
(45) Date of Patent: Mar. 27, 2007

(54) DRESSING ROOM AND CURTAIN SUSPENSION DEVICE

(75) Inventors: Masahiro Shima, Wakayama (JP); Reiji Arikita, Naga-gun (JP)

(73) Assignee: Shima Seiki Manufacturing Limited, Wakayama (JP)

( * ) Notice: Subject to any disclaimer, the term of this patent is extended or adjusted under 35 U.S.C. 154(b) by 655 days.

(21) Appl. No.: 10/450,904

(22) PCT Filed: Dec. 17, 2001

(86) PCT No.: PCT/JP01/11074

§ 371 (c)(1),
(2), (4) Date: Jun. 19, 2003

(87) PCT Pub. No.: WO02/49484

PCT Pub. Date: Jun. 27, 2002

(65) Prior Publication Data

US 2004/0025447 A1 Feb. 12, 2004

(30) Foreign Application Priority Data

Dec. 19, 2000 (JP) ..... 2000-386081

(51) Int. Cl.
*A47H 5/02* (2006.01)
*E06B 3/92* (2006.01)
*E04B 1/343* (2006.01)

(52) U.S. Cl. ..... 52/29; 49/40; 49/41; 135/902; 160/352

(58) Field of Classification Search ..... 52/36.1, 52/36.2, 63, 66, 73, 29, 27.5, 31, 32; 135/129, 135/132, 133, 902; 49/40, 41; 160/210, 160/213, 352
See application file for complete search history.

(56) References Cited

U.S. PATENT DOCUMENTS 641,946 A * 1/1900 McFarland ..... 47/23.2

(Continued)

FOREIGN PATENT DOCUMENTS

FR 2282251 3/1976

(Continued)

OTHER PUBLICATIONS

Microfilm of the specification and drawings annexed to the request of Japanese Utility Model Application No. 134737/1987 (Laid-open No. 41554/1989), (Inax Corporation), Figs. 1 to 3, Mar. 13, 1989.

*Primary Examiner*—Robert Canfield
(74) *Attorney, Agent, or Firm*—Wenderoth, Lind & Ponack, L.L.P.

(57) ABSTRACT

A fitting room (11) as a dressing room is adapted to have its entrance (12) opened and closed by drawing a curtain (14). The curtain is suspended from the tip ends of beam members of a curtain suspension apparatus (15) mounted on a ceiling plate (17). When closing the entrance (12), the curtain suspension apparatus (15) can deploy the curtain (14) in such a manner as to spread it outwardly relative to the fitting room (11) with respect to the entrance (12). The interior space closed with the curtain (14) can thus be enlarged when the curtain (14) is closed to use the fitting room (11). When the curtain (14) is opened, the space that was occupied by the curtain (14) when it was closed can be used for other purposes.

14 Claims, 20 Drawing Sheets

U.S. PATENT DOCUMENTS

| | | | | | |
|---|---|---|---|---|---|
| 756,091 | A | * | 3/1904 | Altick | 52/71 |
| 2,858,837 | A | * | 11/1958 | Harper | 135/88.05 |
| 2,897,002 | A | * | 7/1959 | Yovich | 296/95.1 |
| 3,599,371 | A | * | 8/1971 | Barroero | 49/30 |
| 3,750,818 | A | * | 8/1973 | Borstcher | 211/95 |
| 4,159,171 | A | * | 6/1979 | Nineberg | 396/589 |
| 5,159,947 | A | * | 11/1992 | Chuang et al. | 135/132 |
| 5,452,547 | A | * | 9/1995 | Baloga et al. | 52/32 |

FOREIGN PATENT DOCUMENTS

| | | |
|---|---|---|
| JP | 49-107518 | 9/1974 |
| JP | 55-19769 | 2/1980 |
| JP | 59-160749 | 10/1984 |
| JP | 63-280166 | 11/1988 |
| JP | 64-41554 | 3/1989 |
| JP | 04044706 | 2/1992 |
| JP | 9-131250 | 5/1997 |
| JP | 10-46846 | 2/1998 |

* cited by examiner

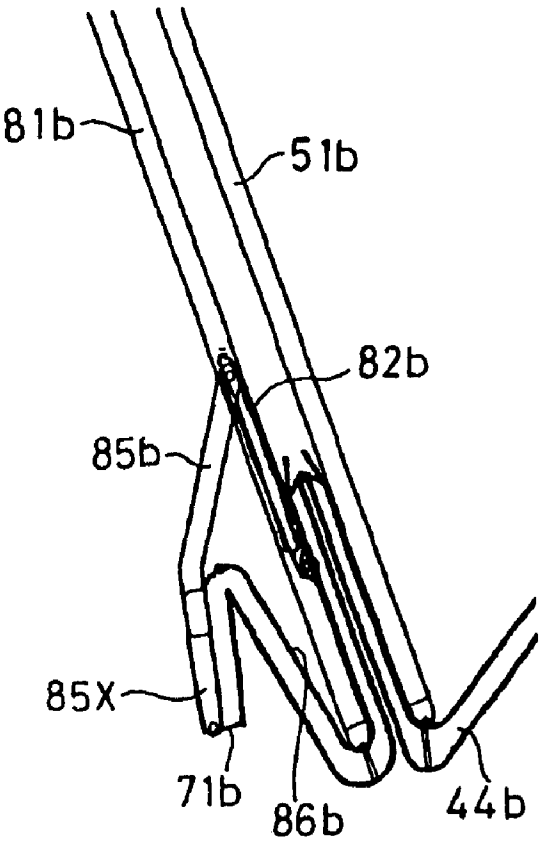
FIG. 18
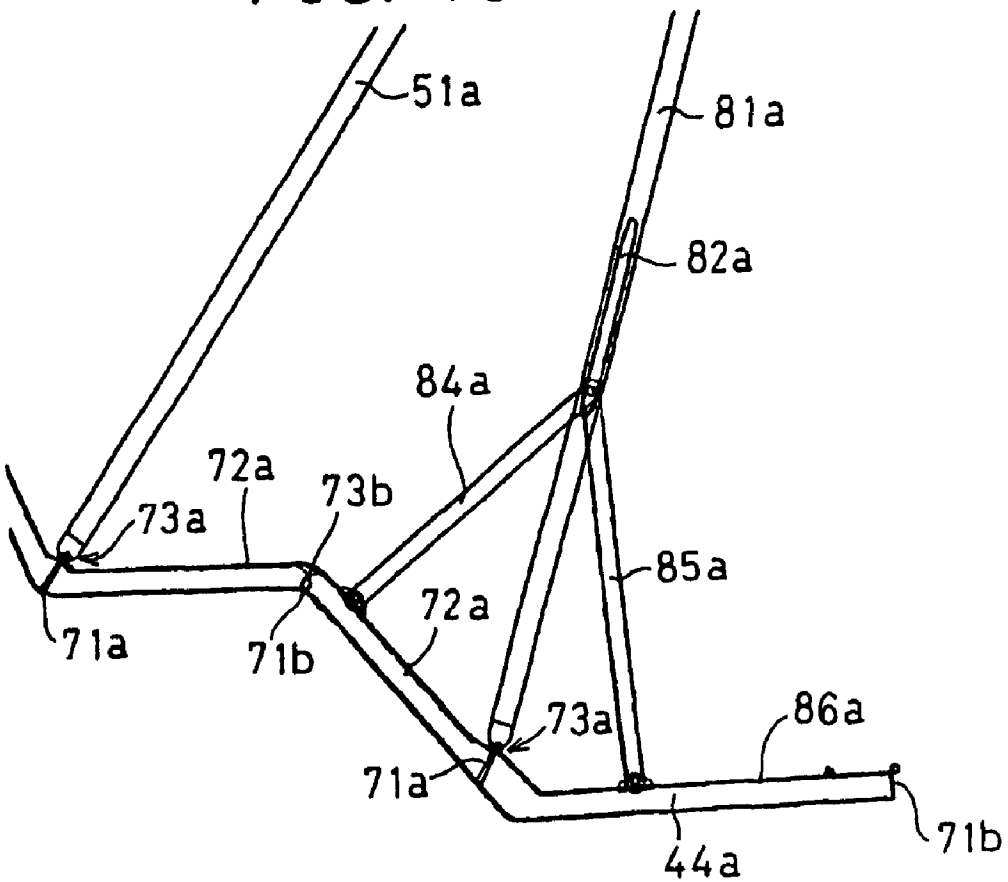

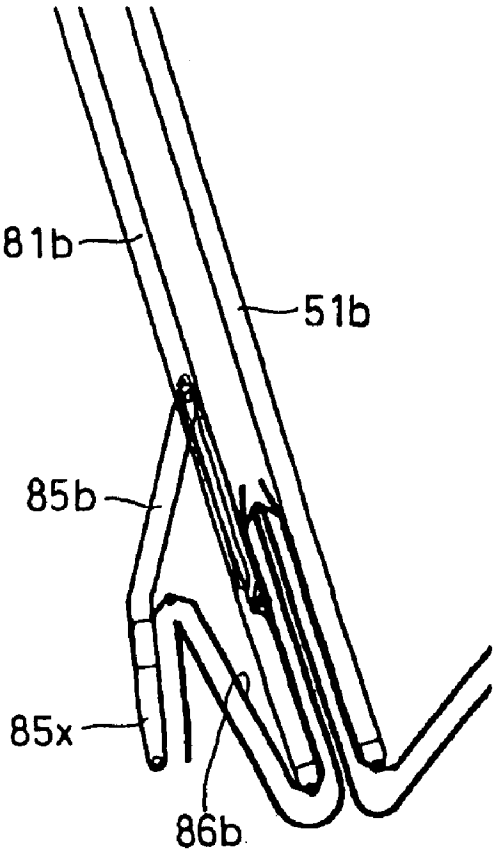
FIG. 19
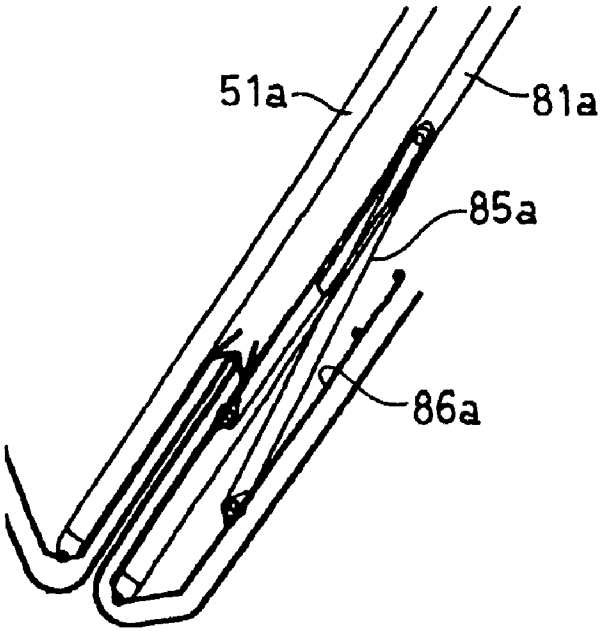

DRESSING ROOM AND CURTAIN SUSPENSION DEVICE

TECHNICAL FIELD

The present invention relates to a dressing room for changing clothes or the like, and more particularly to a dressing room that can be advantageously used for such purposes as a fitting room in an apparel retail store or the like, and a curtain suspension apparatus for use with the same.

BACKGROUND ART

In purchasing apparel products such as dresses and suits in an apparel retail store and the like, it is usual that customers actually try them on. In a retail store such as a boutique or in a specialty shop in a department store or the like, a fitting room is installed, and is used when a customer tries clothes on to see whether the clothes fits his or her size, is comfortable to wear, or becomes him or her. While the customer is trying the clothes on, the entrance of the fitting room is closed with a curtain or the like to protect privacy.

FIG. 21 shows an external view of a typical fitting room 1 commonly used today. A customer who wants to try clothes on enters the fitting room 1 through an entrance 2. Usually, a mirror 3 for the customer to view himself or herself while trying clothes on is hung on a wall on the side opposite from the entrance 2. Since the trying on of clothes involves changing clothes, the entrance 2 is closed with a curtain 4 to protect privacy. The curtain 4 is suspended from a curtain rail 5 fixed to the ceiling, and is moved by being guided along the curtain rail 5. The curtain rail 5 is attached extending in a straight line from the position directly above the entrance 2 toward both ends thereof. The curtain 4 is drawn out along the curtain rail 5 to close over the entrance 2, and is folded up onto one side of the entrance 2 when opening the entrance 2. The construction for opening and closing the entrance 2 by drawing the curtain 4 as described above is not only used for the fitting room 1 in a retail shop or the like, but also used widely for dressing rooms where privacy must be protected in a simple manner during the changing of clothes, etc.

In the fitting room 1 which is opened and closed by drawing the curtain 4 as shown in FIG. 21, the curtain 4 has the function of protecting privacy by hiding the interior of the fitting room 1 from view from the outside. The space that can be secured inside the fitting room 1 when the curtain 4 is closed is substantially the same as the space that the fitting room 1 occupies when the entrance 2 is left open with the curtain 4 opened. If the fitting room 1 were also used, for example, as a storeroom for storing merchandise, it would inconvenience customers when trying clothes on; therefore, the space must be secured as a dedicated space. However, since the trying on of clothes is not done at all times, when the fitting room 1 is not in use the space secured for the fitting room 1 is not effectively utilized. If the space occupied by the fitting room 1 is reduced, the space not effectively utilized when the fitting room 1 is not in use can be reduced, but this compromises the usability of the fitting room 1 because the space for changing clothes is reduced. Furthermore, when the space is reduced, the customer can only look into the mirror 3 from a very close distance, making it difficult to view, for example, the full length or the upper part of his or her body comfortably, even if the mirror 3 itself is large enough. One possible way to reduce the space of the fitting room 1 without compromising the usability as a clothing changing space is to enlarge the interior space when the fitting room 1 is used for its intended purpose.

A prior art technique for enlarging space within a building is disclosed, for example, in Japanese Unexamined Patent Publication JP-A 63-280166 (1988). This prior art concerns a retractable membrane roof structure generally known as a "dome" and applicable to an all-weather athletic stadium or event hall; in this structure, both ends of an arc-shaped unit roof structural frame are guided on two parallel rails installed along the periphery of the opening of an open top structure and the opening is closed with the upwardly domed membrane. Such a structure can extend the space upward, but cannot be used to enlarge a clothing changing space usable in a dressing room such as the fitting room 1.

An object of the invention is to provide a dressing room and a curtain suspension apparatus that can enlarge the available space when in use while reducing the occupied space when not in use.

DISCLOSURE OF INVENTION

The invention provides a dressing room having an entrance capable of being opened and closed with a curtain. A plurality of beam members, arranged in an upper part of the dressing room, suspend the curtain from tip ends thereof. A guiding mechanism, while supporting the plurality of beam members at base ends thereof in such a manner that the beam members project outwardly relative to the dressing room in a substantially horizontal position, guides the base ends of the beam members in such a manner that when the tip ends are positioned above the entrance, spacing between the beam members adjacent to each other at the tip ends becomes wider than spacing between the beam members adjacent to each other at the base ends. When the tip ends are positioned displaced sideways from the position above the entrance, spacing between the beam members adjacent to each other at the tip ends becomes narrower than the spacing when the tip ends are positioned above the entrance.

According to the invention, a dressing room having an entrance capable of being opened and closed with a curtain includes a plurality of beam members and a guiding mechanism. The plurality of beam members are arranged in an upper part of the dressing room and are used for suspending the curtain from the tip ends thereof. While supporting the plurality of beam members at the base ends thereof in such a manner that the beam members project outwardly relative to the dressing room in a substantially horizontal position, the guiding mechanism guides the base ends of the beam members in such a manner that when the tip ends are positioned above the entrance, spacing between the beam members adjacent to each other at the tip ends becomes wider than spacing between the beam members adjacent to each other at the base ends. When the tip ends are positioned displaced sideways from the position above the entrance, spacing between the beam members adjacent to each other at the tip ends becomes narrower than the spacing when the tip ends are positioned above the entrance. Since the curtain is suspended from the tip ends of the beam members, the curtain spreads outwardly relative to the entrance when closing over the entrance, and is retracted into one side of the entrance when the entrance is opened. When the curtain is closed, the space shielded from the outside by the curtain extends outwardly relative to the entrance, thus enlarging the usable space in the dressing room. When the curtain is opened, since the curtain is retracted into one side of the entrance, the space that was occupied by the curtain when it was drawn out can be effectively used for other purposes.

In the invention, it is preferable that the dressing room further comprises a sidewall member which forms sidewall surfaces excluding the entrance and a holding member for holding the guiding mechanism in an upper part of the sidewall member.

According to the invention, the dressing room includes a sidewall member and a holding member. The sidewall member forms sidewall surfaces excluding the entrance. The holding member holds the guiding mechanism in an upper part of the sidewall member. A unitized dressing room can be realized when the sidewall and the holding member are included therein, and the dressing room can be easily installed even in an unpartitioned space. The dressing room, when installed, provides a wider usable space in the dressing room since the curtain spreads outwardly when the curtain is closed over the entrance and, when not in use, the space can be used for other purposes.

In the invention, it is also preferable that the sidewall member is provided at a lower end thereof with a moving member that makes an entire structure of the dressing room movable.

According to the invention, since the dressing room unitized with the sidewall member and the holding member can be moved by means of the moving member attached to the lower end thereof, the dressing room can be used as a movable, temporary dressing room, fitting room, etc. in various kinds of event halls and the like.

In the invention, it is preferable that the dressing room further comprises a motor for moving the plurality of beam members in such a manner that the base ends are guided by the guiding mechanism.

According to the invention, since the motor moves the plurality of beam members in such a manner that the base ends are guided by the guiding mechanism, the curtain can be easily opened and closed by operating a switch for controlling the motor.

The invention also provides a curtain suspension apparatus for drawing a curtain for closing an opening therewith, comprising a plurality of beam members for suspending the curtain from tip ends thereof. A guiding mechanism, while supporting the plurality of beam members at base ends thereof in such a manner that the beam members project outwardly relative to the opening in a substantially horizontal position, guides the base ends of the beam members in such a manner that when the tip ends are positioned above the opening, spacing at the tip ends between the beam members adjacent to each other becomes wider than spacing at the base ends and between the beam members adjacent to each other. When the tip ends are positioned displaced sideways from the position above the opening, spacing between the beam members adjacent to each other at the tip ends becomes narrower than the spacing when the tip ends are positioned above the opening.

According to the invention, the curtain suspension apparatus for opening and closing an opening with a curtain includes a plurality of beam members and a guiding mechanism. The curtain is suspended from the tip ends of the plurality of beam members. While supporting the plurality of beam members at the base ends thereof in such a manner that the beam members project outwardly relative to the opening in a substantially horizontal position, the guiding mechanism guides the base ends of the beam members in such a manner that when the tip ends are positioned above the opening, spacing at the tip ends between the beam members adjacent to each other becomes wider than spacing at the base ends and between the beam members adjacent to each other. When the tip ends are positioned displaced sideways from the position above the opening, spacing between the beam members adjacent to each other at the tip ends becomes narrower than the spacing when the tip ends are positioned above the opening. The curtain suspended from the tip ends of the beam members spreads outwardly relative to the opening when closing over the opening, and is retracted into one side of the opening when the opening is opened. When the curtain is closed, the space shielded from the outside by the curtain extends outwardly relative to the opening, thus enlarging the usable space in the dressing room. When the curtain is opened, since the curtain is retracted into one side of the opening, the space that was occupied by the curtain when it was drawn out can be effectively used for other purposes.

In the invention, it is preferable that the guiding mechanism includes a plurality of supporting members each of which is connected to each of the base ends of the plurality of beam members and a guiding member for guiding the plurality of supporting members in such a manner that a spreading angle between the beam members becomes larger in an area above the opening, and becomes smaller in an area displaced sideways from the area above the opening.

According to the invention, the guiding member includes a plurality of supporting members and a guiding member. Each of the plurality of supporting members is connected to each of the base ends of the plurality of beam members. The guiding member guides the plurality of supporting members in such a manner that the spreading angle between the beam members becomes larger in an area above the opening, and becomes smaller in an area displaced sideways from the area above the opening. Since the spreading angle between the beam members becomes larger in the area above the opening, the curtain suspended from the tip ends of the beam members can be spread out.

BRIEF DESCRIPTION OF DRAWINGS

FIG. 18 is a plan view showing the condition shortly before the condition of FIG. 17 is achieved.

FIG. 19 is a plan view showing the condition shortly before the condition of FIG. 18 is achieved.

BEST MODE FOR CARRYING OUT THE INVENTION

Figure 1:
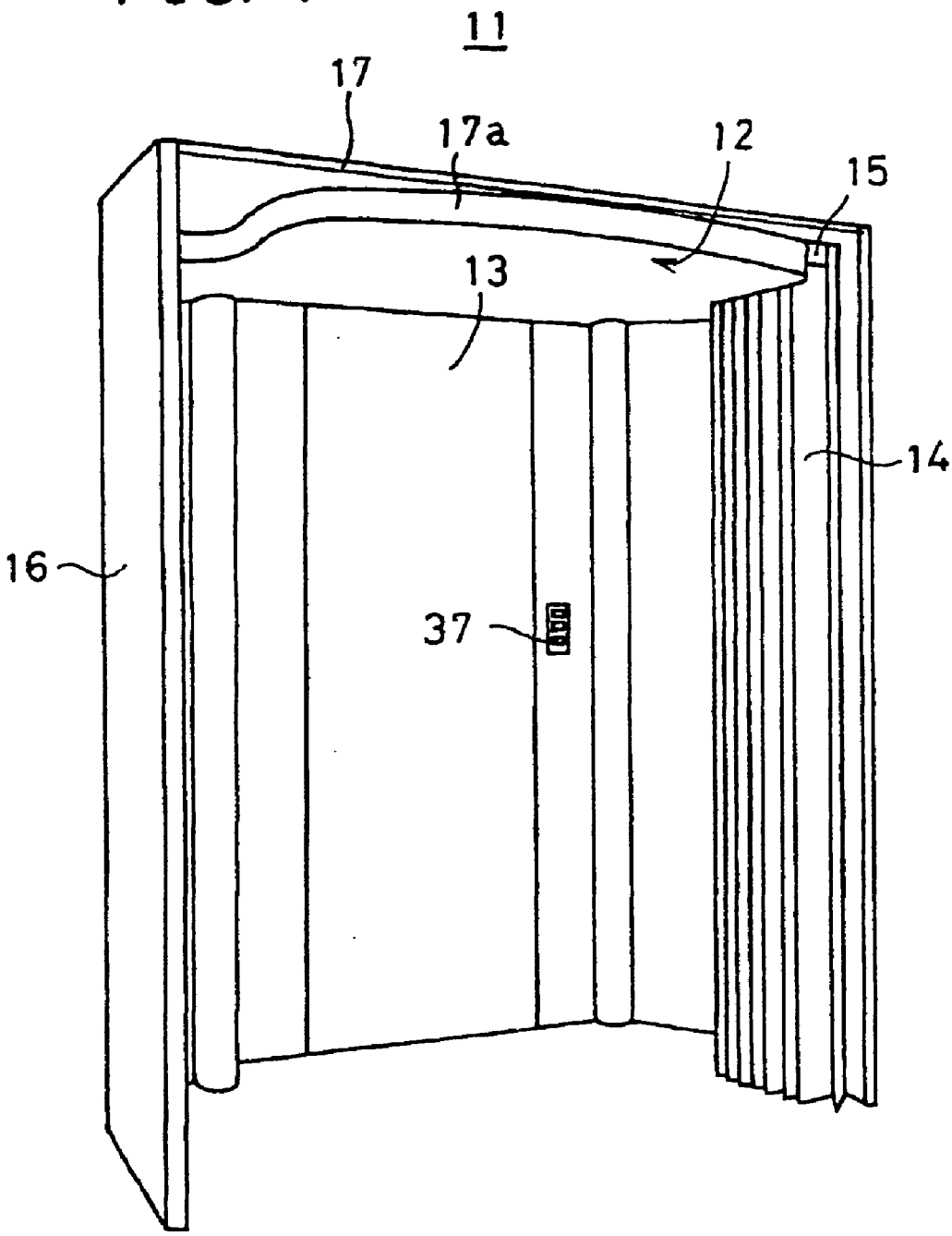
FIG. 1 is a diagram showing the condition in which a curtain 14 is opened in a fitting room 11 according to one embodiment of the invention.
Figure 2:
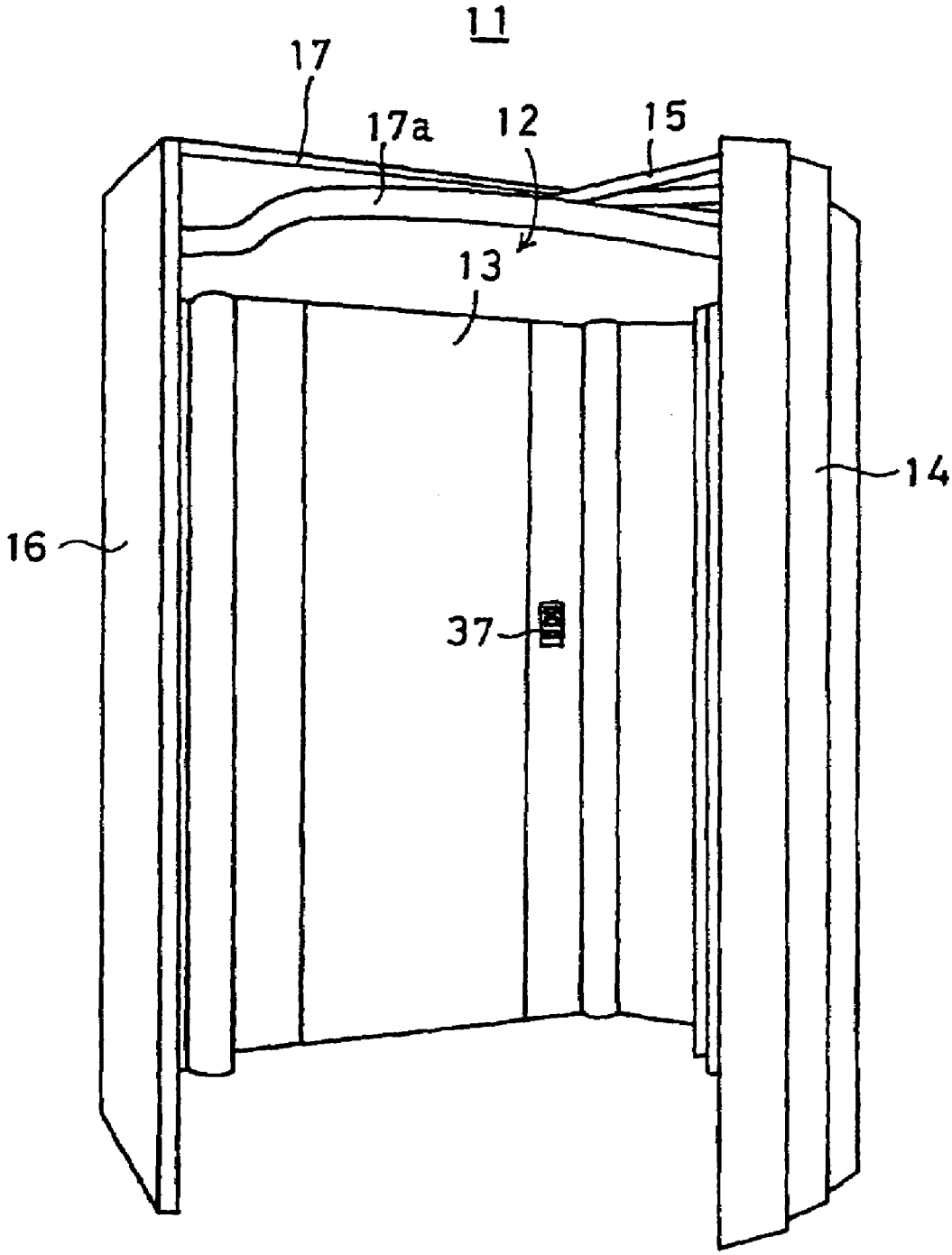
FIG. 2 is a diagram showing the condition in which the curtain 14 is partially closed in the fitting room 11 of FIG. 1.
Figure 3:
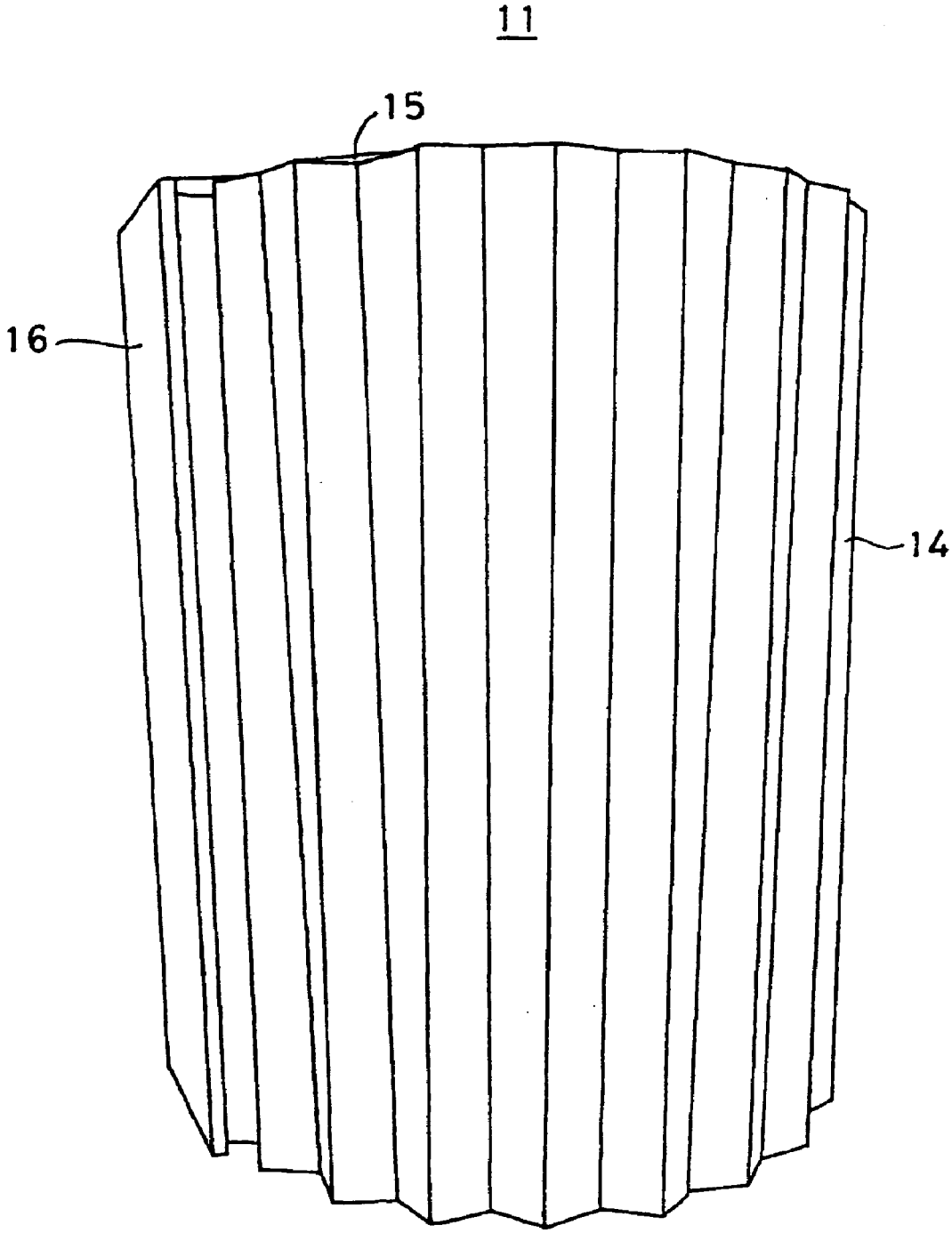
FIG. 3 is a diagram showing the condition in which the curtain 14 is closed in the fitting room 11 of FIG. 1.

FIGS. 1 to 3 show the construction of a fitting room 1 as a dressing room according to one embodiment of the present invention. FIG. 1 shows the condition in which an entrance 12 as an opening of the fitting room 1 is opened, FIG. 2 shows the condition in which the entrance is partially closed, and FIG. 3 shows the condition in which the entrance 12 is closed. In the fitting room 11, a mirror 13 as a full-length mirror in which a customer views himself or herself while trying clothes on is attached to a wall on the side opposite from the entrance 12, and the entrance 12 is opened and closed by drawing a curtain 14. The curtain 14 is suspended from above by a curtain suspension apparatus 15. When opening the entrance 12, the curtain suspension apparatus 15 folds up the curtain 14 into its standby position at one side of the entrance 12, as shown in FIG. 1. When closing the entrance 12, the curtain suspension apparatus 15 draws out the curtain 14 in such a manner as to extend forwardly of the entrance 12, as shown in FIGS. 2 and 3, providing a wider space usable in the fitting room 11 than would be the case if the fitting room 11 were closed at the position of the entrance 12.

The fitting room 11 of this embodiment includes a sidewall member 16 which forms sidewall surfaces excluding the entrance 12, and a plate-like holding member 17 whose periphery is joined to an upper part of the sidewall member 16, and to which the curtain suspension apparatus 15 is fixedly held. Since the fitting room 11, including the sidewall member 16 and the holding member 17, is unitized, the fitting room 11 can be readily installed even in a space where no partitions are provided. Further, since the curtain 14 spreads outwardly when the curtain 14 is closed over the entrance, the fitting room 11 provides a wide interior space for use as the fitting room 11, and when not in use, the space can be used for other purposes. A ceiling plate 17*a* is provided under the holding member 17 to hide the curtain suspension apparatus 15, etc. from view from inside the fitting room 11.

The sidewall member 16 may be provided at its lower end with a moving member such as casters 99 (see FIG. 4) to facilitate moving the entire structure of the fitting room 11. If provided with a moving member, the fitting room 11 unitized with the sidewall member 16 and the holding member 17 can be used as a movable, temporary dressing room, fitting room, etc. in various kinds of event halls and the like.

Figure 4:
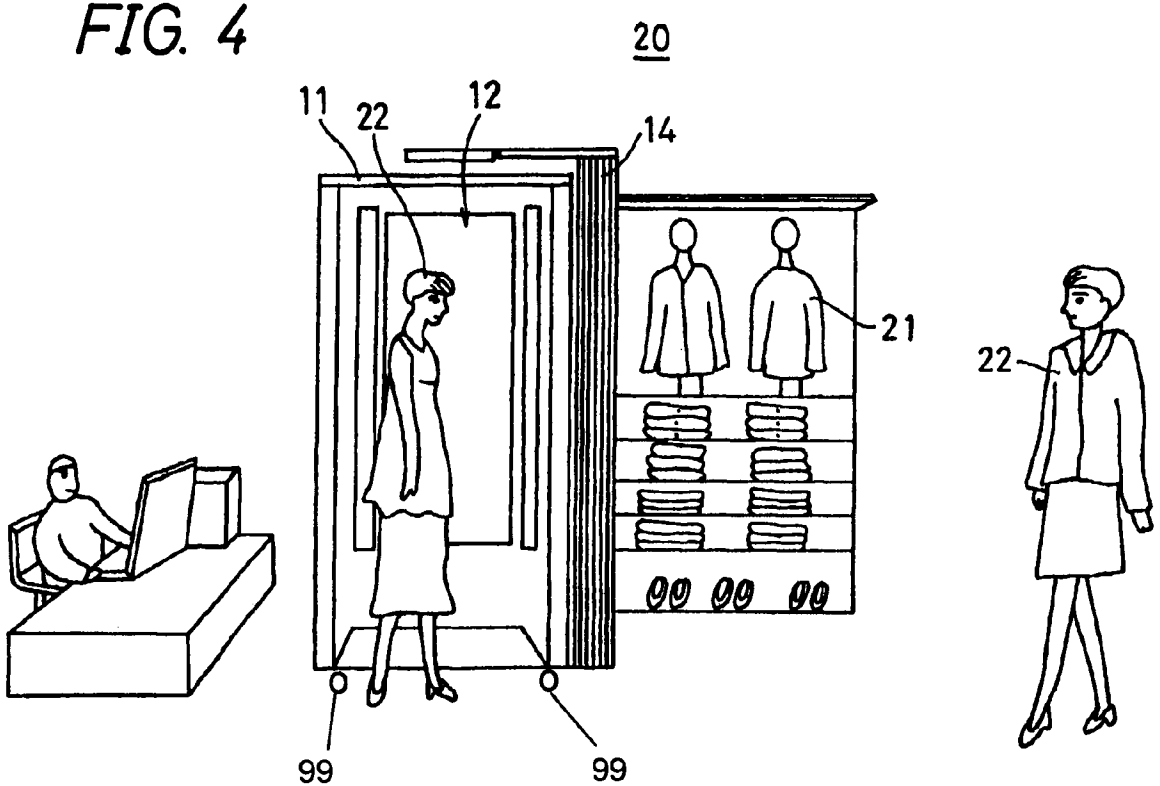
FIG. 4 is a diagram showing the fitting room 11 of FIG. 1 installed in an apparel retail store.

FIG. 4 shows an arrangement for using the fitting room 11 shown in FIGS. 1 to 3 to assist the sale of apparel products. In an apparel retail store 20, the fitting room 11 of this embodiment is installed to have customers try on apparel products 21 such as dresses. The curtain 14 provided on the fitting room 11 is opened to open the entrance 12 of the fitting room 11, and is closed to provide a space in the fitting room 11 hidden from view from the outside. When the curtain 14 is closed, the curtain 14 spreads forwardly of the entrance 12 to enlarge the space usable in the fitting room 11. The customer 22 who visited the store can comfortably try on the apparel product 21 in the fitting room 11. The customer can stand against the closed curtain 14 in the fitting room 11 and view himself or herself in the mirror 13 while trying the product on. When the fitting room 11 is not in use, the curtain 14 is folded away into one side of the entrance 12 to leave the entrance 12 open. The space occupied when the curtain 14 is closed over the entrance 12 extends outwardly relative to the fitting room 11 with respect to the entrance 14, and when the curtain 14 is opened, this space can be used for other purposes such as a passage for customers 22.

Figure 5:
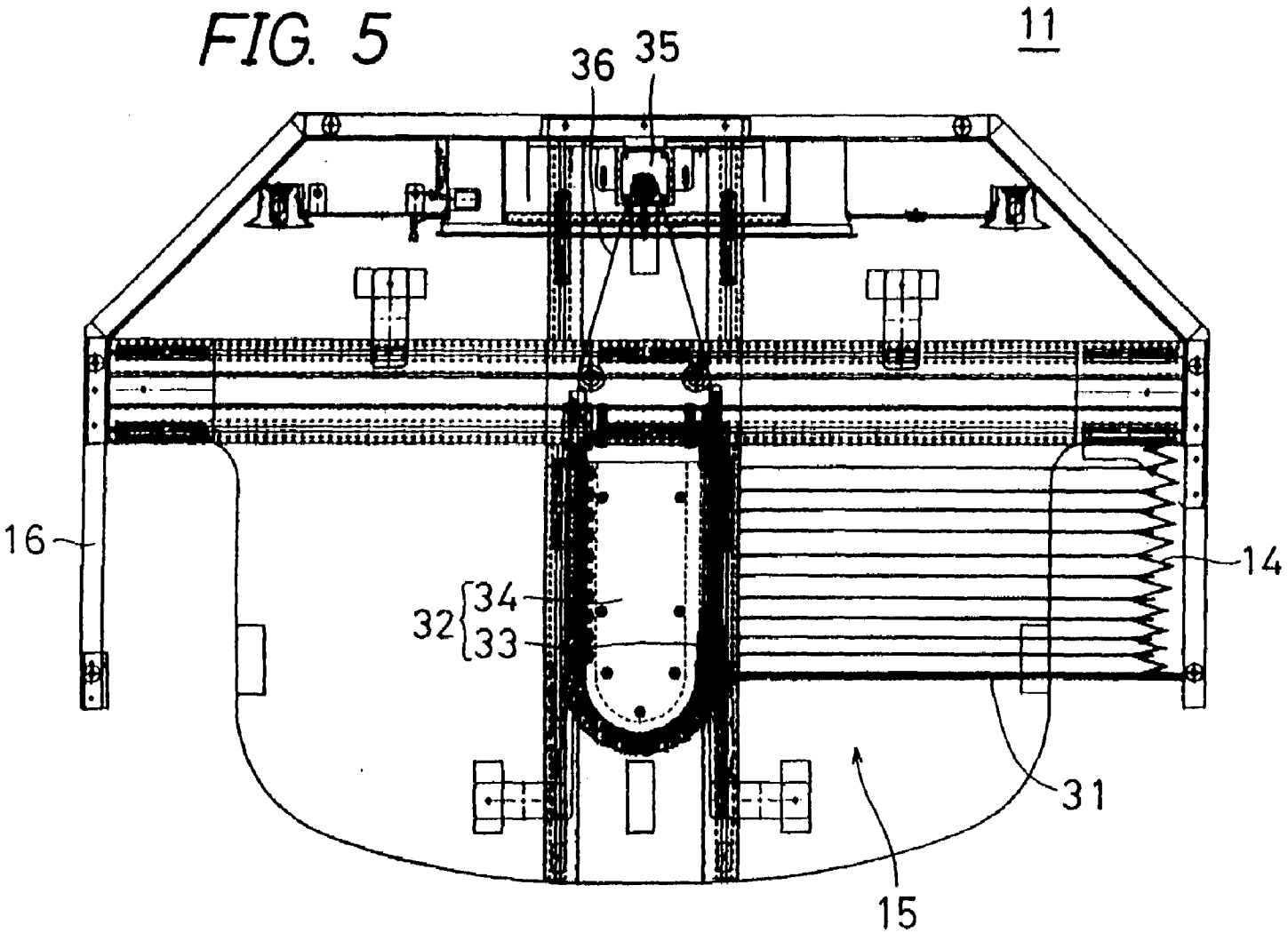
FIG. 5 is a schematic plan view showing the condition in which the curtain 14 is opened in the fitting room 11 of FIG. 1.
Figure 6:
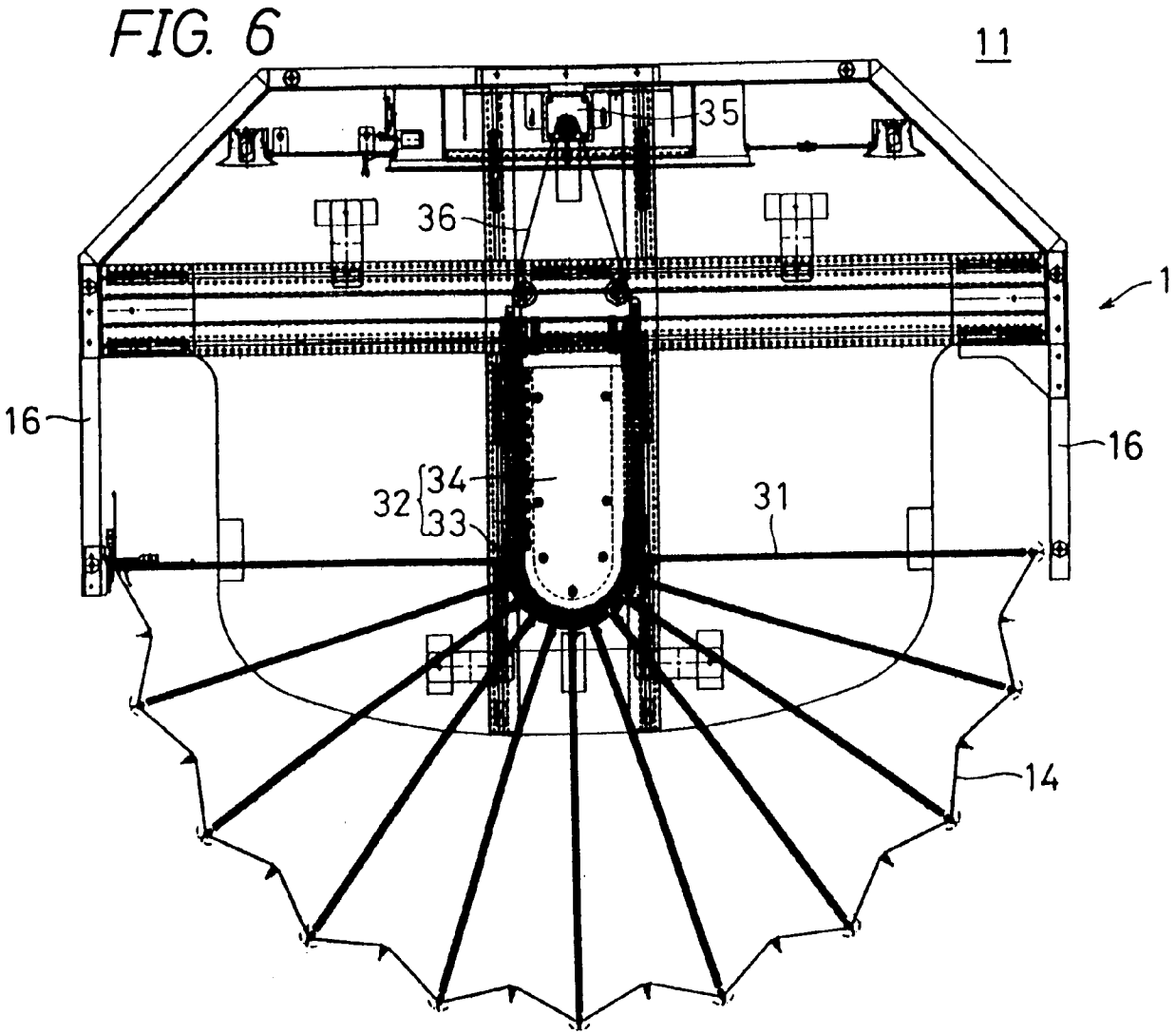
FIG. 6 is a schematic plan view showing the condition in which the curtain 14 is closed in the fitting room 11 of FIG. 1.

FIGS. 5 and 6 are top plan views showing the fitting room 11 of the embodiment illustrated in FIGS. 1 to 3, with the holding member 17 removed to reveal the construction of the curtain suspension apparatus 15. FIG. 5 shows the condition corresponding to FIG. 1 in which the curtain 14 is opened, and FIG. 6 shows the condition corresponding to FIG. 2 in which the curtain 14 is closed. The curtain suspension apparatus 15 of this embodiment includes a guiding mechanism 32 and a plurality of beam members 31 for suspending the curtain 14 from their tip ends. The guiding mechanism 32 supports the base ends of the plurality of beam members 31 in such a manner that the beam members 31 project outwardly relative to the entrance 12 in a substantially horizontal position. The guiding mechanism 32 guides the base ends in such a manner that when the tip ends of the beam members 31 are positioned above the entrance 12, spacing at the tip ends between the beam members 31 adjacent to each other becomes wider than spacing at the base ends between the beam members 31 adjacent to each other. When the tip ends are positioned displaced sideways from the position above the entrance 12, spacing at the tip ends between the adjacent beam members 31 becomes narrower than the spacing when the tip ends are positioned above the entrance 12. The curtain 14 suspended from the tip ends of the beam members 31 spreads outwardly relative to the entrance 12 when closing over the entrance 12, and is retracted into one side of the entrance 12 when the entrance 12 is opened. When the curtain 14 is closed over the entrance 12, the space shielded from the outside by the curtain 14 extends outwardly relative to the entrance 12, thus enlarging the space usable in the fitting room 11. When the curtain 14 is drawn to open the entrance 12, the curtain 14 is retracted into one side of the entrance 14. As a result, the space occupied by the curtain 14 when it was spread out can be used effectively for other purposes.

In this embodiment, the guiding mechanism 32 includes a plurality of supporting members 33 and a guiding member 34. The base ends of the plurality of beam members 31 are joined to the respective supporting members 33. The guiding member 34 guides the plurality of supporting members 33 in such a manner that the spreading angle between the beam members 31 becomes larger in the area above the entrance 12, as shown in FIG. 6, and becomes smaller in the area displaced sideways from the position above the entrance 12, as shown in FIG. 5.

The curtain 14 suspended from the tip ends of the radially spreading beam members 31 can be drawn to open and close the entrance 12 of the fitting room 11. As shown in FIG. 5, when the curtain 14 is opened, the curtain 14 is folded up with the beam members 31 brought close together, and is thus retracted into one side of the entrance of the fitting room 11. In this condition, the floor space that the fitting room 11 occupies becomes small. As shown in FIG. 6, when the curtain 14 is closed, the base ends of the beam members 31 are guided by the guiding member 34 in such a manner that the spacing spreads out at the tip ends. In this way, the space usable in the fitting room 11 can be enlarged with the curtain 14 spreading out over an extended area. A motor 35 is provided to move the beam members 31. The motor 35 can move the supporting members 33 along the guiding member 34 by driving a belt 36. With the provision of the motor 35, the curtain 14 can be opened and closed by operating a switch 37 mounted in the surface of the sidewall member 16 of the fitting room 11, as shown in FIGS. 1 and 2.

Figure 7:
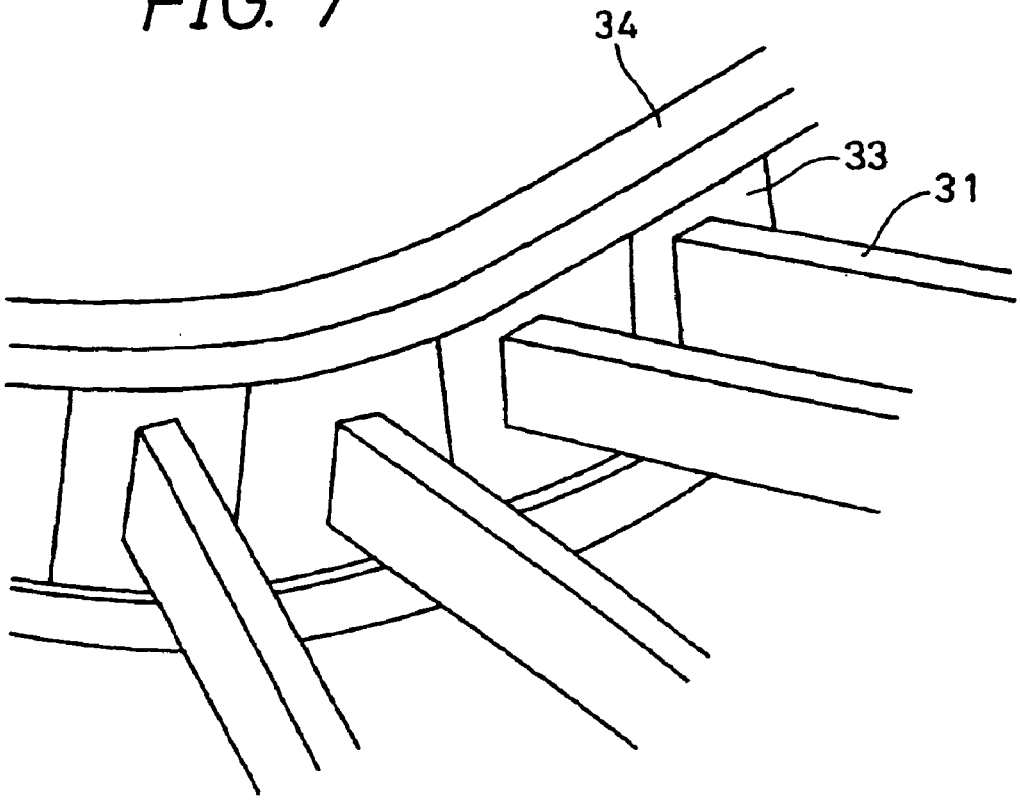
FIG. 7 is a perspective view showing the construction of a portion relating to supporting members 33 in a curtain suspension apparatus 15 in FIG. 1.

FIG. 7 shows the construction of a portion relating to the supporting members 33 of this embodiment. The plurality of supporting members 33 are connected together in a chain-like manner, i.e. as a chain, and are movable along the guiding member 34. The supporting members 33 support thereon the base ends of the respective beam members 31. In a straight section of the guiding member 34, the adjacent beams 31 are positioned parallel to each other, and the spacing between them is closed. In a curved section of the guiding member 34, the adjacent beams 31 are radially spread out, the spacing between them being wider at the tip ends than at the base ends.

Figure 8:
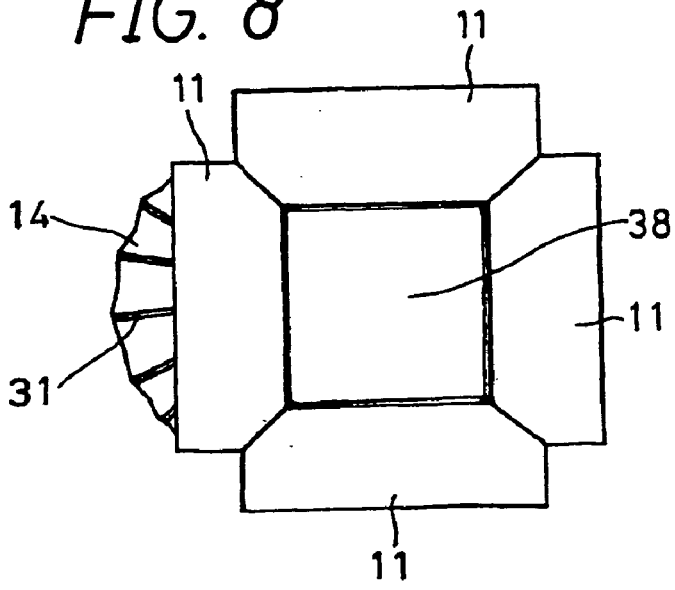
FIG. 8 is a simplified plan view showing how fitting rooms 11, each identical to the one shown in FIG. 1, are arranged around a pillar 38.

FIG. 8 shows one example in which a plurality of fitting rooms 11 according to this embodiment are arranged. When there is a pillar 38 or the like in a large room, the plurality of fitting rooms 11 can be arranged in such a manner as to surround the pillar 38. When the sidewall member 16 of each fitting room 11 is constructed by forming its rear side corners at an angle of 45°, for example, a maximum of four fitting rooms 11 can be arranged in a clustered manner around the pillar 38, and the space can be effectively utilized by concealing the pillar 38 that can interfere with the layout.

Figure 9:
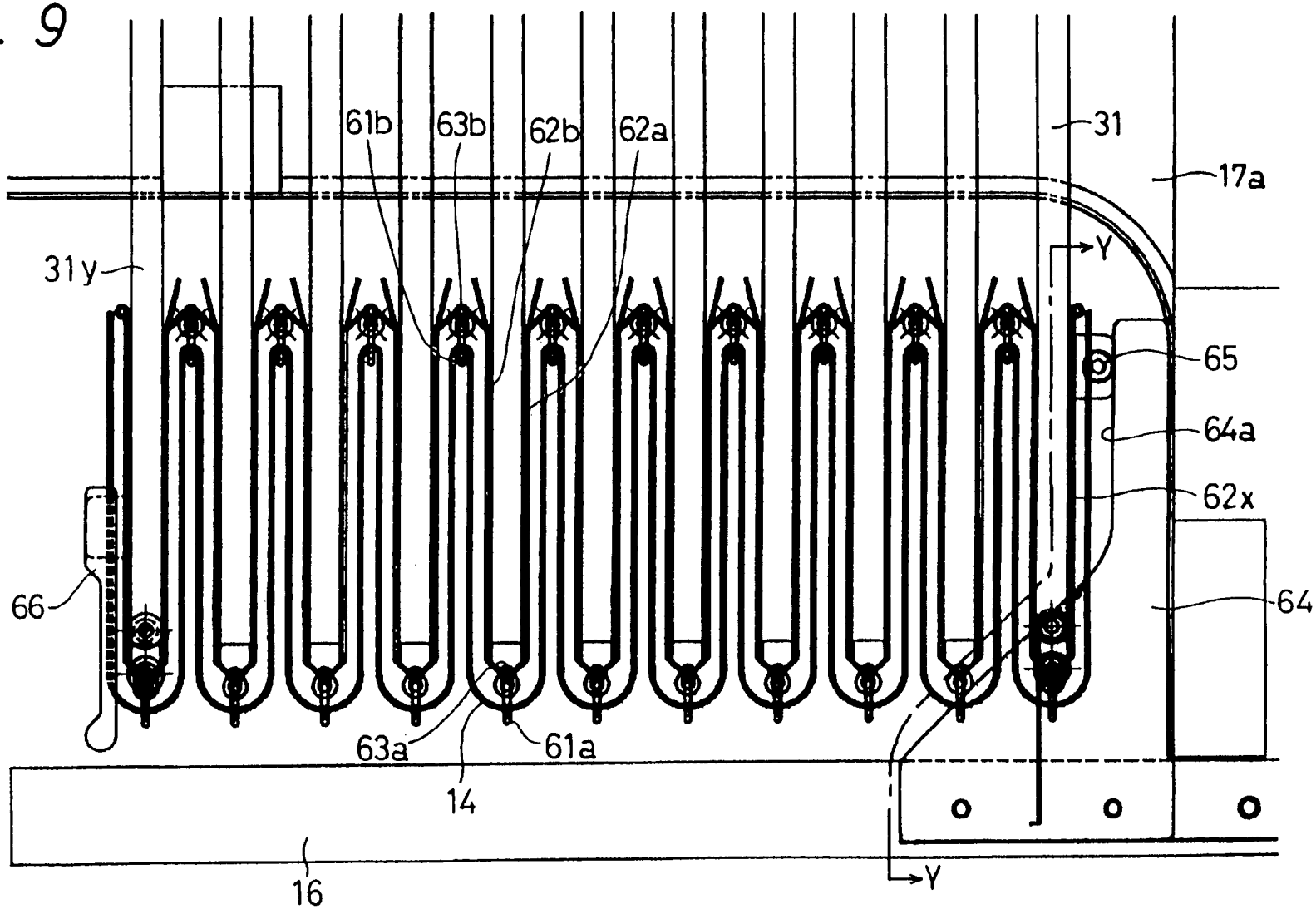
FIG. 9 is a plan view showing the construction of a portion of the curtain 14 accommodated in the condition of FIG. 5.
Figure 10:
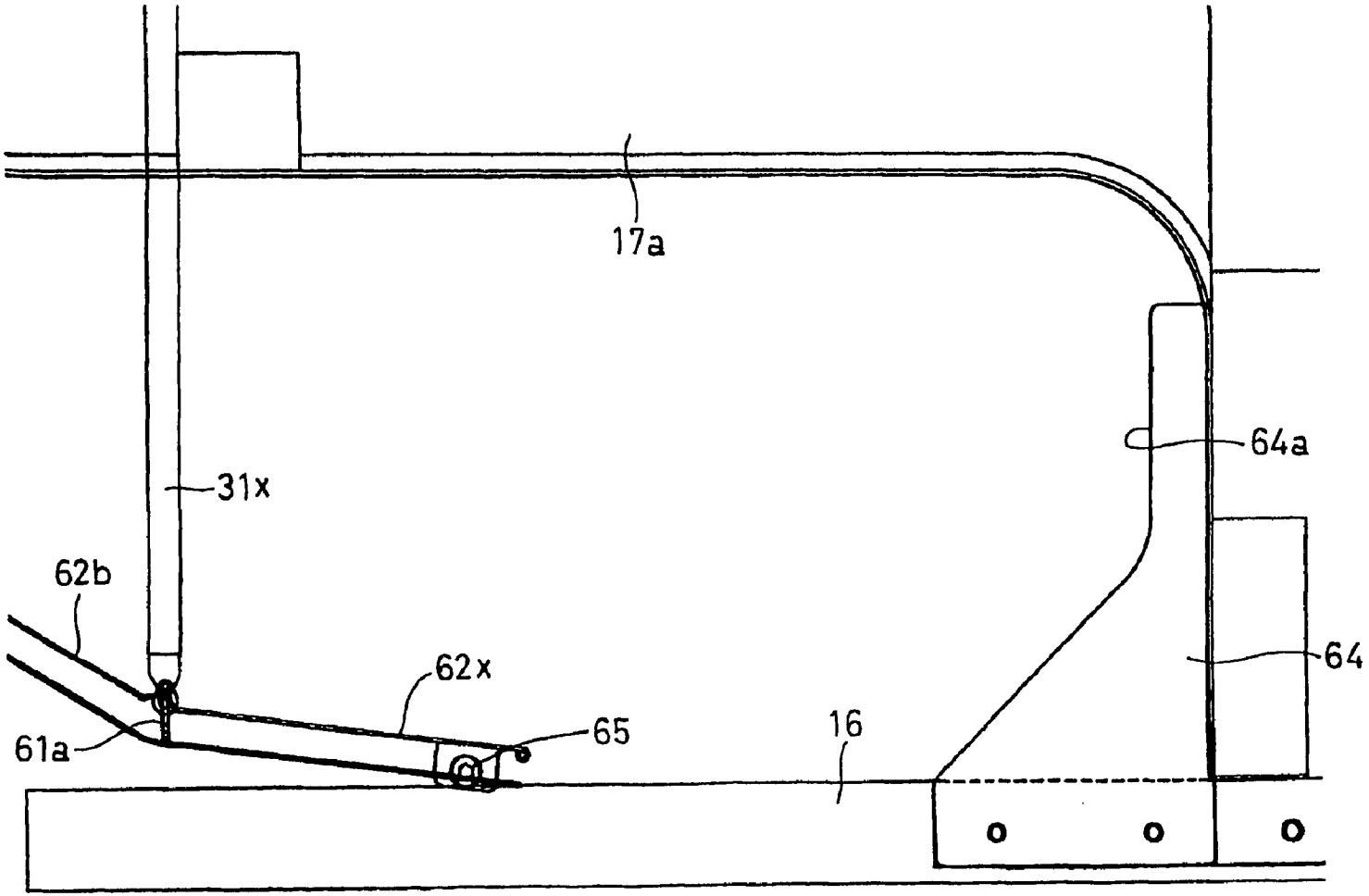
FIG. 10 is a plan view showing the endmost portion of the curtain 14 in the condition of FIG. 6.
Figure 11:
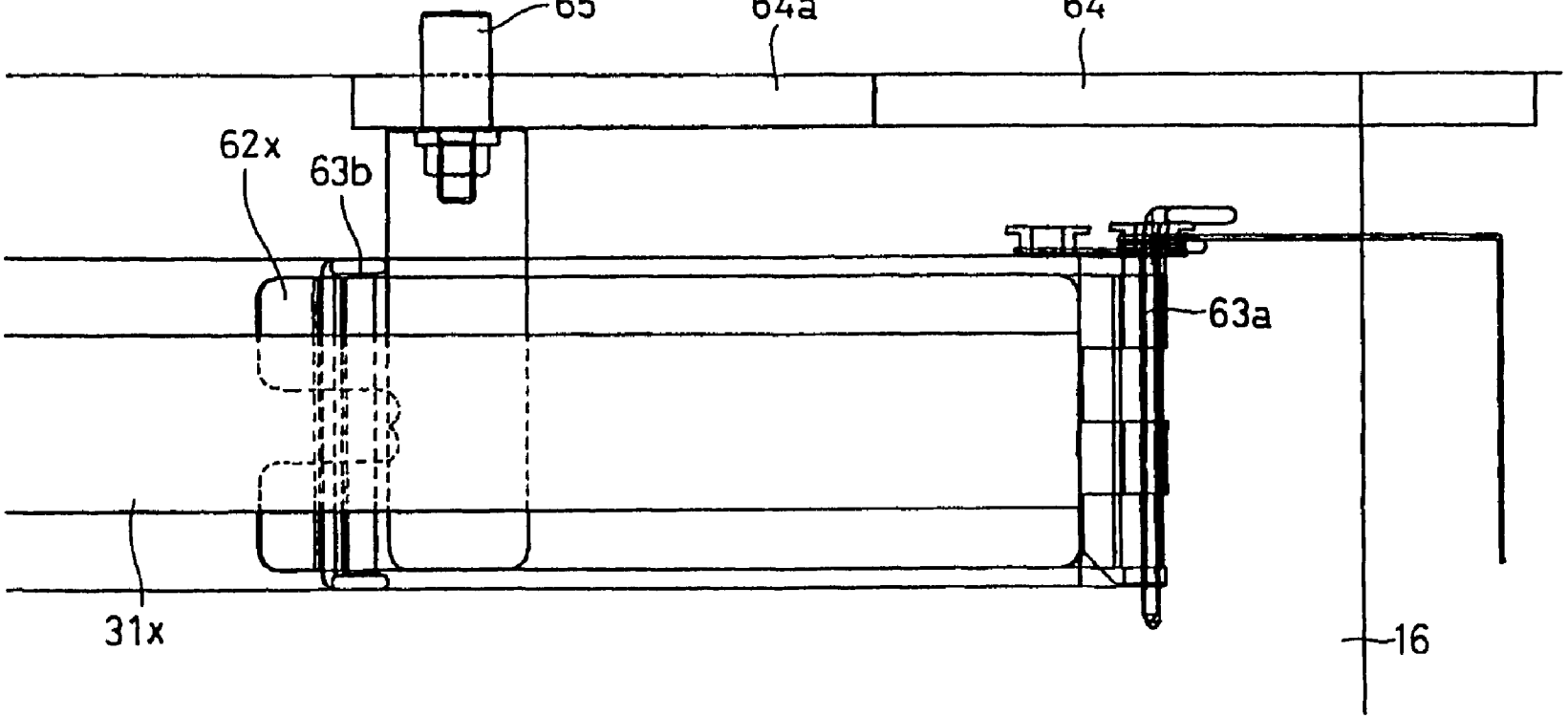
FIG. 11 is a view as seen from section Y—Y in FIG. 9.
Figure 12:
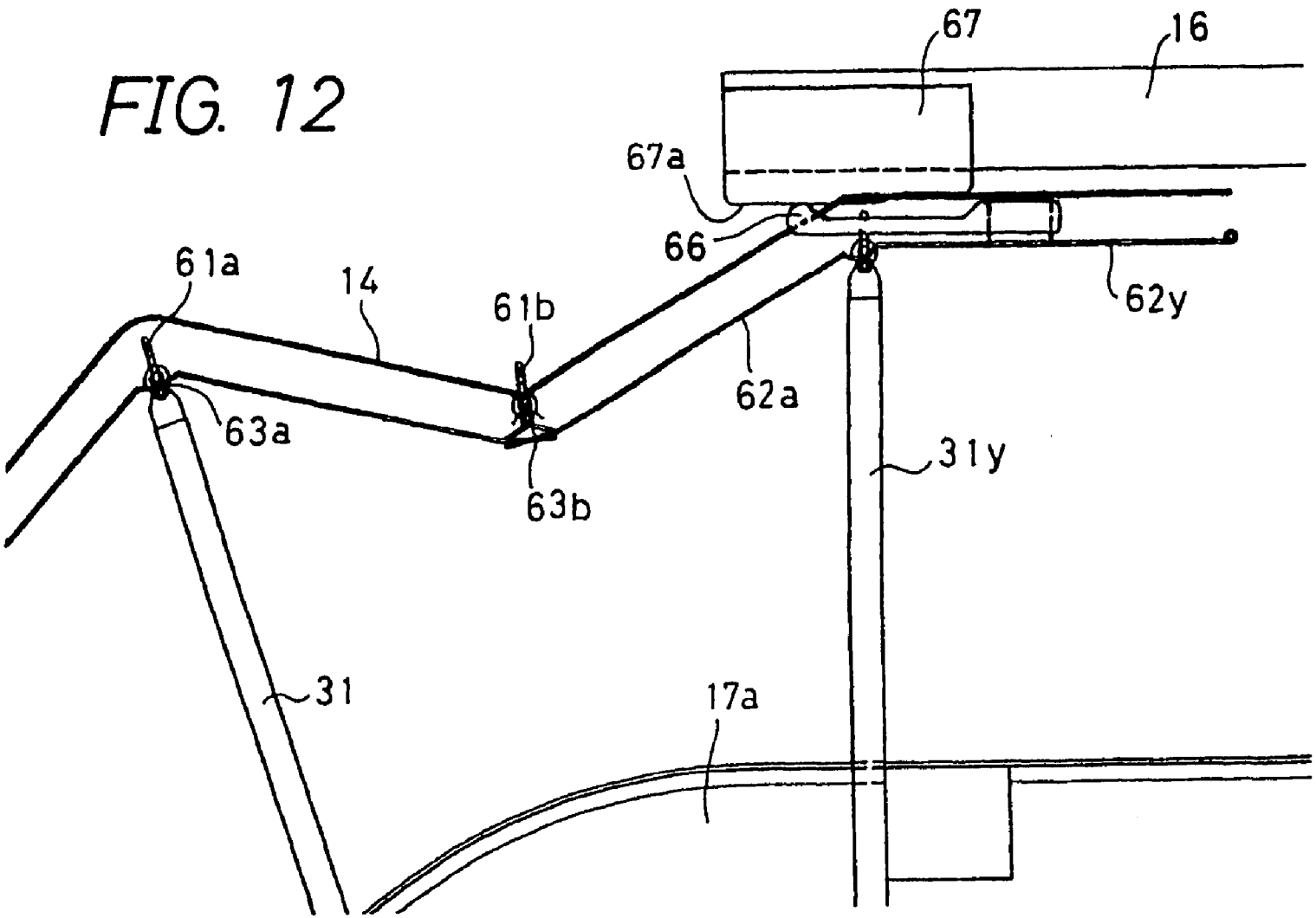
FIG. 12 is a plan view showing the foremost portion of the curtain 14 in the condition of FIG. 6.
Figure 13:
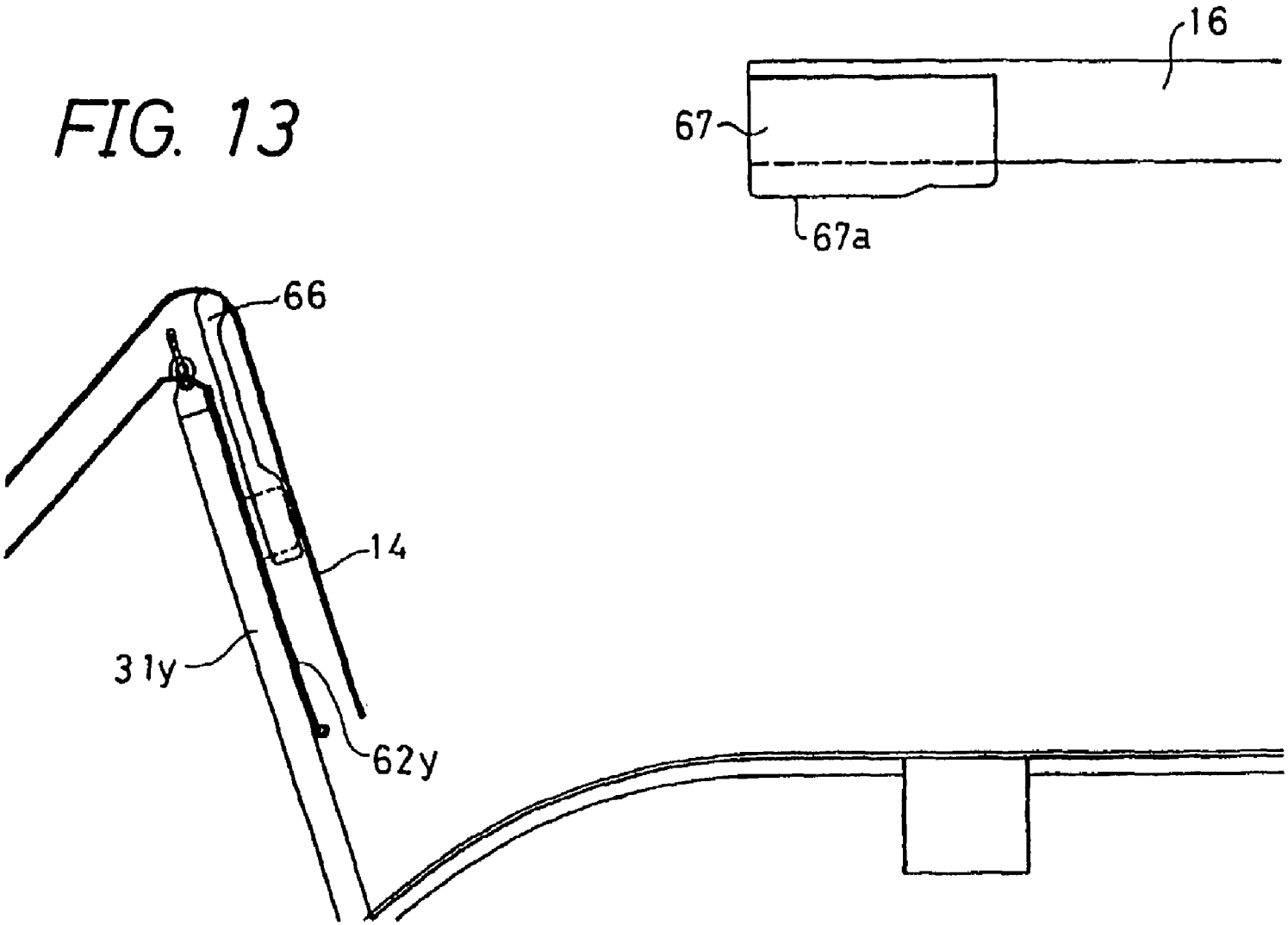
FIG. 13 is a plan view showing the condition shortly before the condition of FIG. 12 is achieved.
Figure 14:
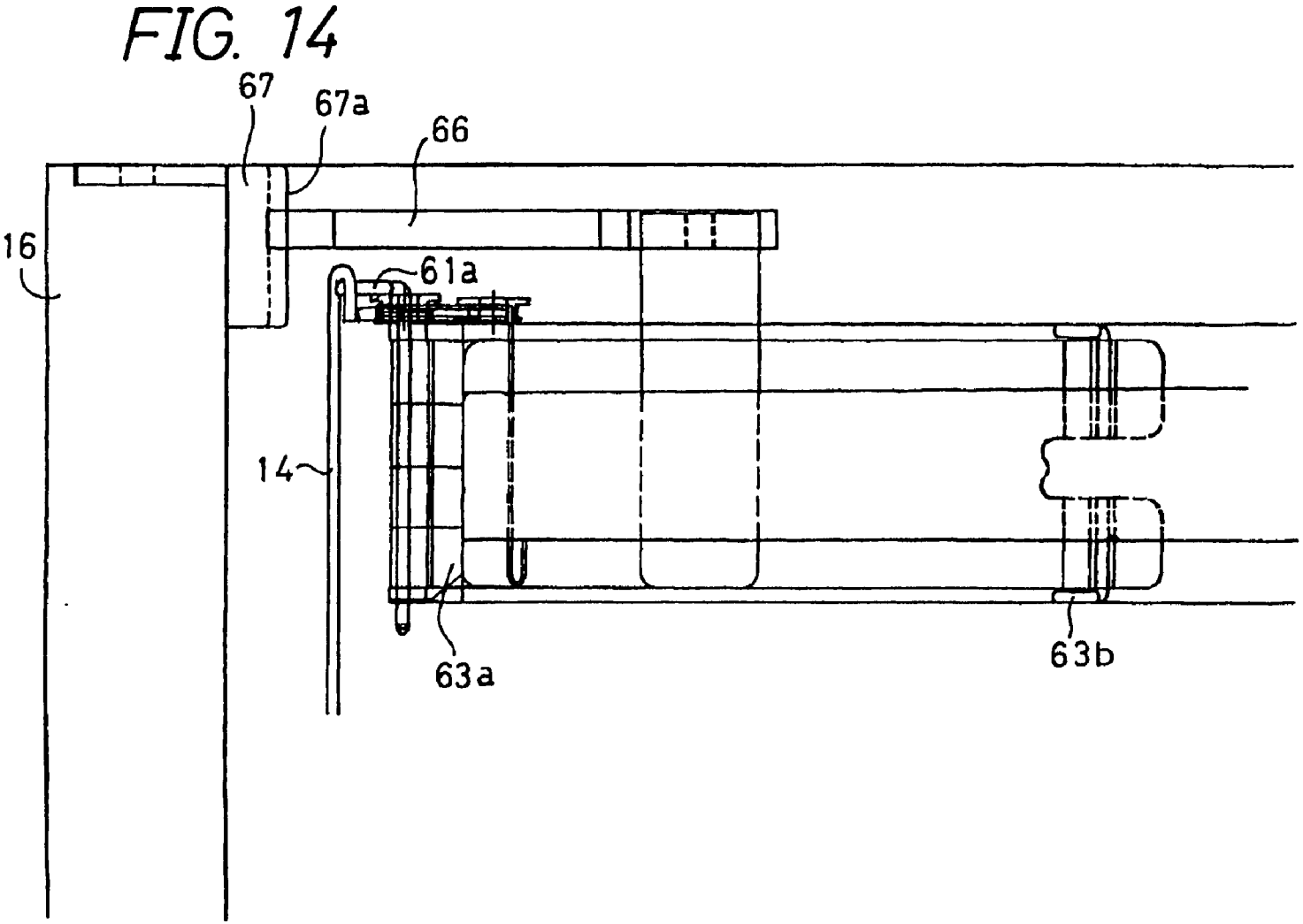
FIG. 14 is a front view showing a portion relating to a lever 66 in FIG. 12.

FIGS. 9 to 14 show the detailed construction of the portion where the curtain 14 is suspended from the tip ends of the beam members 31. FIG. 9 shows the condition in which the entrance 12 is left open with the curtain 14 retracted into position as shown in FIG. 5. FIG. 10 shows the condition near the endmost beam member 31*x* when the entrance 12 is closed with the curtain 14 spread out as shown in FIG. 6. FIG. 11 shows a view as seen from the Y—Y direction in FIG. 9. FIG. 12 shows the condition near the foremost beam member 31*y* when the entrance 12 is closed with the curtain 14 as shown in FIG. 6. FIG. 13 shows the condition immediately before the foremost end of the curtain 14 closes the entrance 12 as shown in FIG. 12. FIG. 14 shows the same portion as that shown in FIG. 12 but viewed from the front side.

As shown in FIG. 9, the curtain 14 is suspended by a hook 61*a* at a convex folded edge protruding toward the outside of the fitting room 11, and by a hook 61*b* at a concave folded edge protruding toward the inside of the fitting room 11. The hook 61*a* at the convex folded side is supported at the tip end of the corresponding beam 31. On the reverse side of the curtain 14 are provided guide plates 62*a* and 62*b*, and the adjacent guide plates 62*a* and 62*b* are connected by a hinge 63*a* or 63*b*. The hinge 63*a* as well as the hook 61*a* is supported at the tip end of the beam member 31. Between the adjacent beam members 31 are connected the guide plates 62*a* and 62*b* via the hinge 63*b* at which the hook 61*b* is supported. A roller 65 which is guided in contact with a cam face 64*a* of a cam plate 64 is provided near the tip end of the guide plate 62*x* attached to the endmost beam member 31*x*. When retracting the curtain 14, since the roller 65 moves while engaging the cam surface 64*a* of the cam plate 64, the force to fold up the curtain 14 can be exerted on the guide plate 62*x*. The foremost beam member 31*y* is provided with a lever 66 which is used to lock the curtain 14 in its closed position as will be described later. The endmost guide plate 62*x* is urged in a spreading direction by a kick spring not shown.

As shown in FIG. 10, when the curtain 14 is drawn out to close the entrance 12, the roller 65 on the guide plate 62*x* attached to the endmost beam member 31*x* is disengaged from the cam face 64*a*, and the guide plate 62*x* is straightened by the urging force of the kick spring. The guide plate 62*x* thus straightened serves to press the side edge of the curtain 14 against the sidewall member 16 and eliminate the gap therebetween so that the interior of the fitting room 11 will not be seen from the outside.

When closing the curtain 14 over the entrance 12, the guide plate 62*y* attached to the foremost beam member 31*y* is usually urged by a kick spring (not shown) toward the beam member 31*y* as shown in FIG. 13. When the curtain 14 is in its closed position as shown in FIG. 12, the lever 66 provided on the guide plate 62*y* is brought into engagement with a cam face 67*a* of a cam plate 67 provided on the sidewall member 16, causing the guide plate 62*y* to move away from the beam member 31*y* against the urging force of the kick spring, and thus spreading the curtain 14. In this way, the interior of the fitting room 11 can be hidden from view from the outside.

Figure 15:
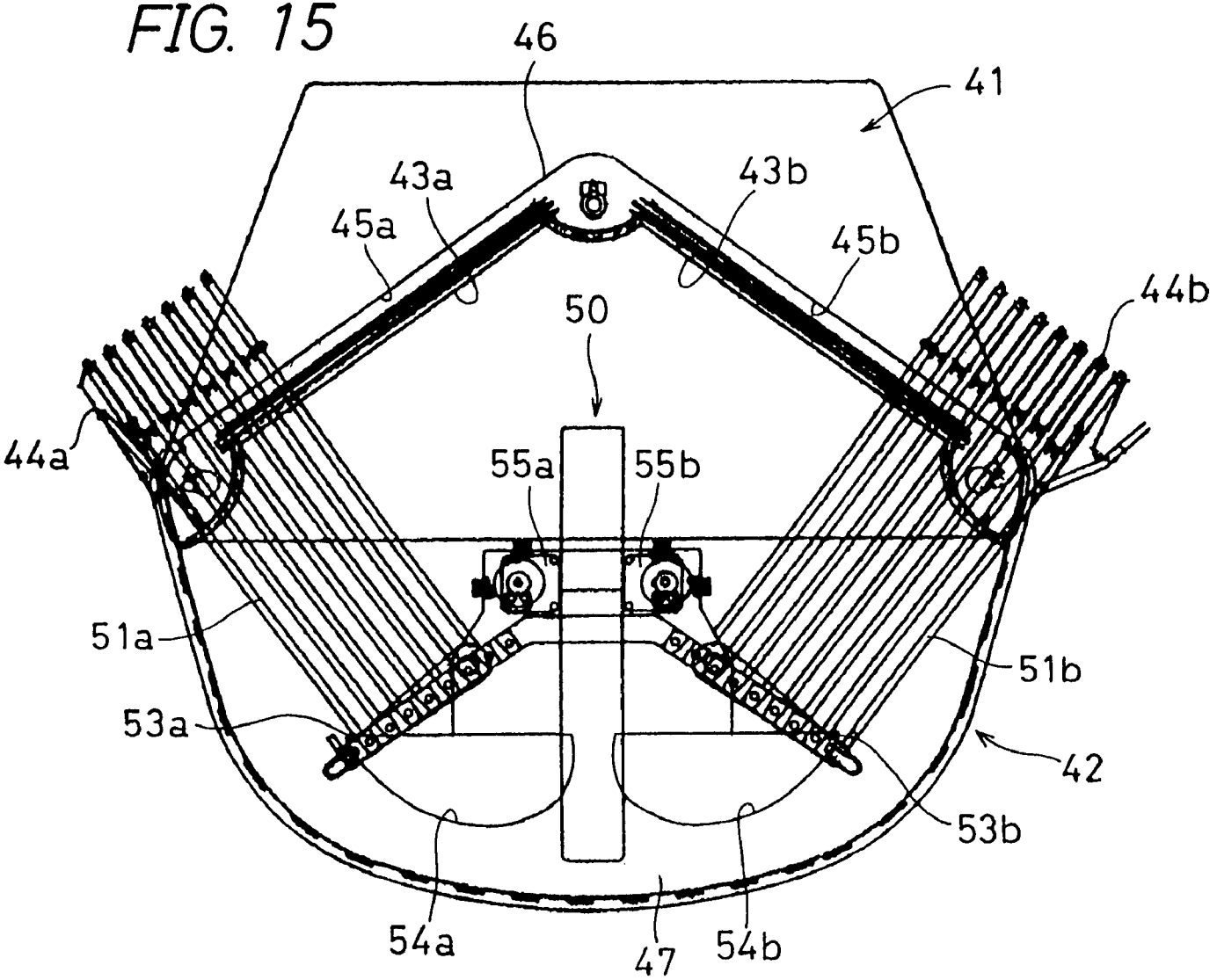
FIG. 15 is a schematic cross sectional plan view showing the condition in which curtains 44*a* and 44*b* are opened in a fitting room 41 according to another embodiment of the invention.
Figure 16:
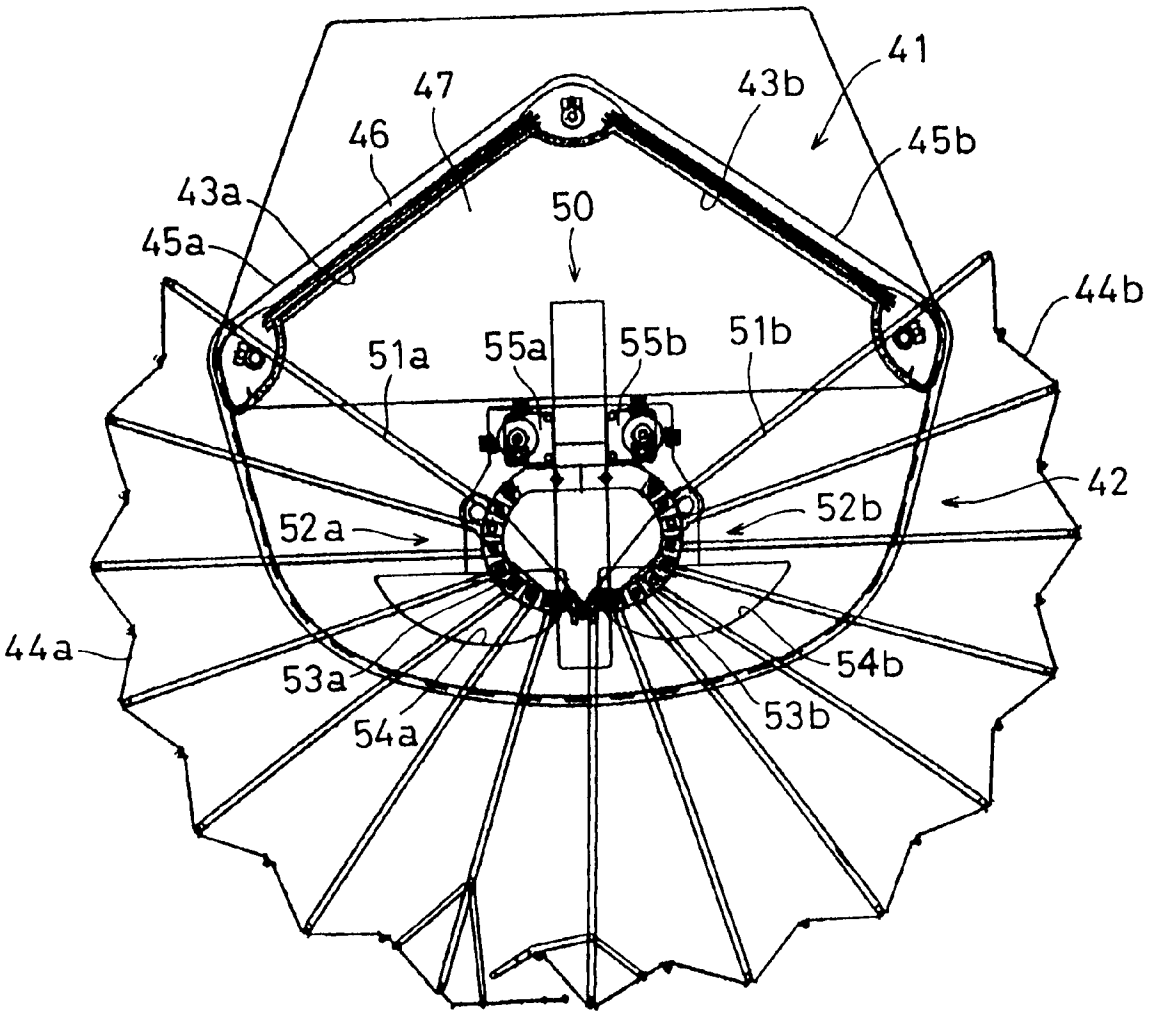
FIG. 16 is a schematic cross sectional plan view showing the condition in which the curtains 44*a* and 44*b* are closed in the fitting room 41 of FIG. 15.

FIGS. 15 and 16 are top plan views showing the construction of a fitting room 41 according to another embodiment of the invention. The fitting room 41 of this embodiment includes two wall surfaces arranged at different angles so that two mirrors 43*a* and 43*b* can be mounted on them. Three or more wall surfaces may be arranged at different angles so that three or more mirrors can be mounted. Since the plurality of mirrors 43*a* and 43*b* are arranged at different angles, the person trying clothes on can view himself or herself not only from a straight-on angle but also from other angles.

FIG. 15 shows the condition in which the curtain 44*a*, 44*b* at the entrance 42 is opened, and FIG. 16 shows the condition in which the curtain 44*a*, 44*b* is closed. In this embodiment, the periphery of the holding member 47 is supported on the sidewall member 46 having the two wall surfaces 45*a* and 45*b*. The curtain 44*a*, 44*b* consists of two split curtains 44*a* and 44*b* which are accommodated into the respective sides of the entrance 42 when opened. The curtains 44*a* and 44*b* are attached to the tip ends of the respective beam members 51*a* and 51*b* of the curtain suspension apparatus 50. The base ends of the beam members 51*a* and 51*b* are guided by the respective guiding mechanisms 52*a* and 52*b* so that, when opening, the curtains 44*a* and 44*b* can be folded up and, when closing, the curtains 44*a* and 44*b* can be drawn so as to spread outwardly relative to the entrance 42. The curtains 44*a* and 44*b* can be moved independently of each other by respective motors 55*a* and 55*b*. The motors 55*a* and 55*b* may be combined into one unit so that the two curtains 44*a* and 44*b* can be moved together. The one-piece curtain 14 shown in FIGS. 1 to 3 can also be used here. Conversely, the split curtains 44*a* and 44*b* shown in this embodiment can also be used for the fitting room 11 shown in FIGS. 1 to 3.

The guiding mechanisms 52*a* and 52*b* of this embodiment respectively include a plurality of supporting members 53*a* and 53*b*, connected together in a chain-like manner, for supporting the base ends of the respective beam members 51*a* and 51*b*. When the curtains are opened, the supporting members are arranged in a straight line, as shown in FIG. 15, and when the curtains are closed, the supporting members are arranged curving along the respective guiding members 54*a* and 54*b* having curved cam faces, as shown in FIG. 16.

In the above embodiments, since the curtains 14, 44*a*, and 44*b* are attached to the tip ends of the respective beam members 31, 51*a*, and 51*b*, the space occupied by the closed curtains 14, 44*a*, and 44*b* can be freed when the curtains are opened. A curtain that spreads outwardly could be achieved by using a curtain rail or the like, but in that case, the curtain rail would remain suspended in midair when the curtain was closed, which would be undesirable in a retail shop or the like. When the motors 35, 55*a*, and 55*b* are not used, the curtains 14, 44*a*, and 44*b* can be opened and closed by manually pulling the curtains.

Figure 17:
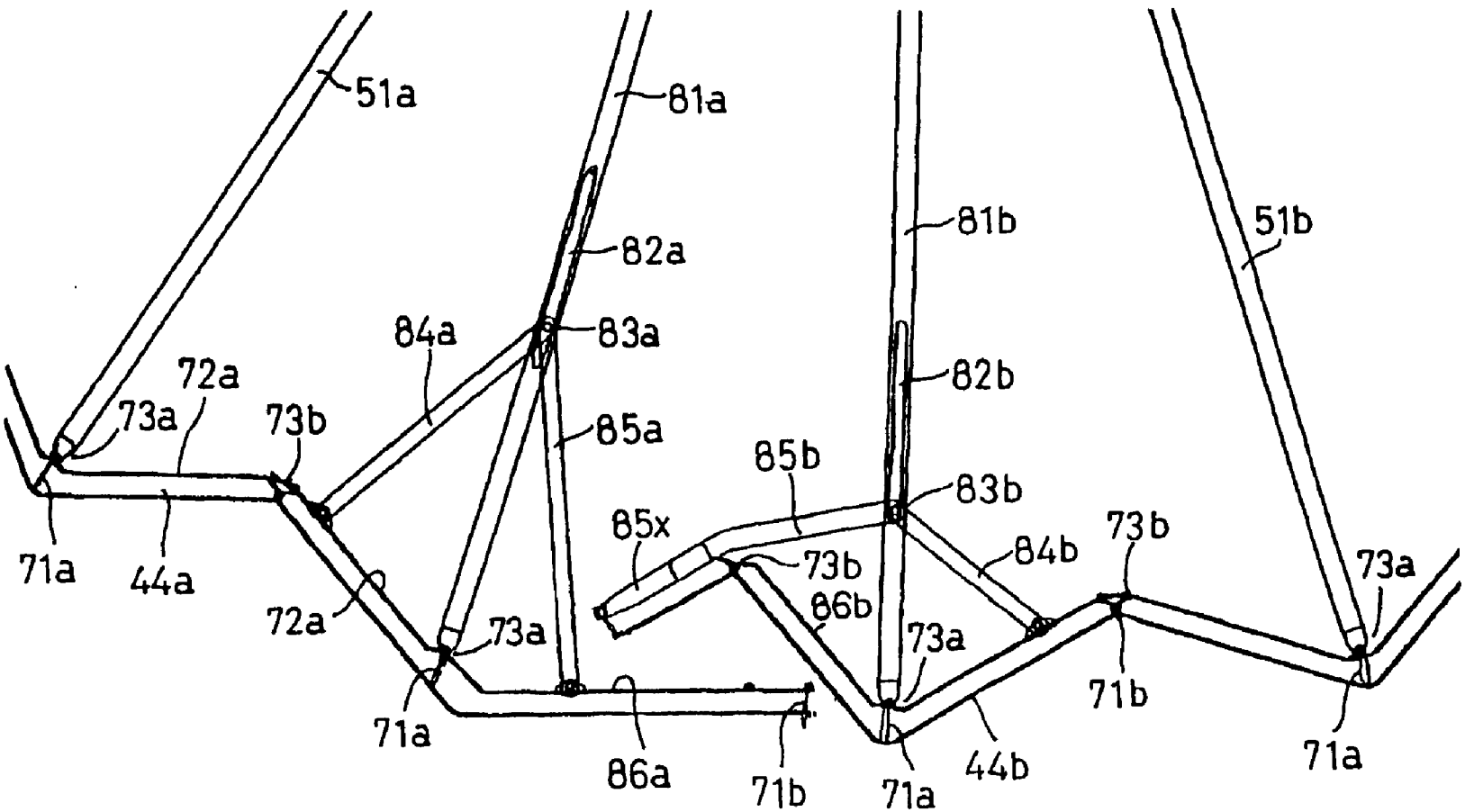
FIG. 17 is a plan view showing a portion where the curtains 44*a* and 44*b* are closed in FIG. 16.
Figure 20:
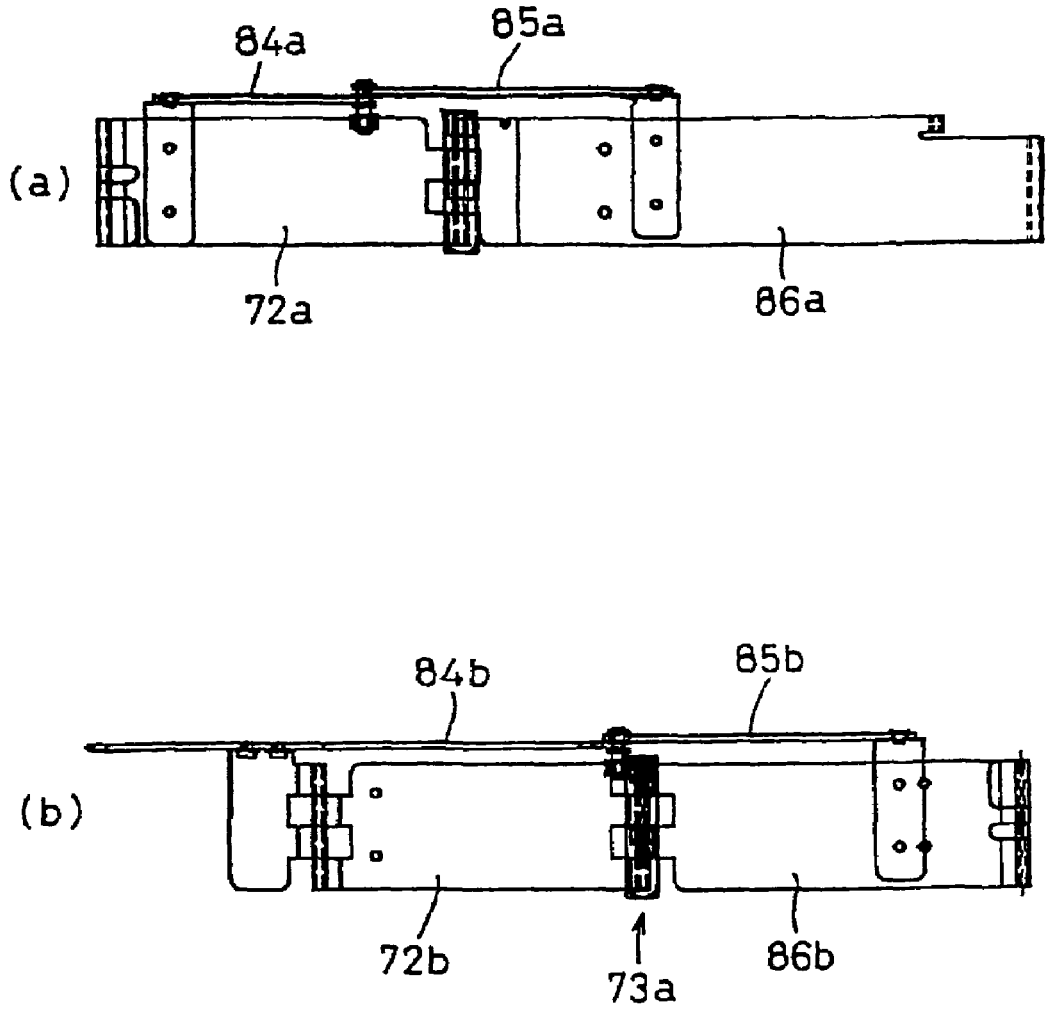
FIG. 20 is a side view showing tip end portions with the curtains 44*a* and 44*b* removed from them.
Figure 21:
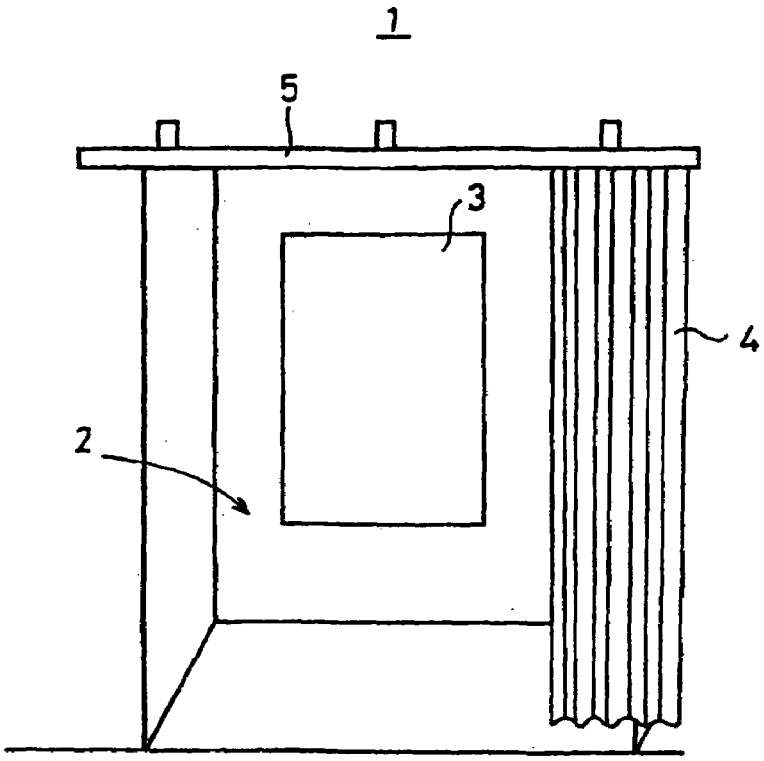
FIG. 21 PRIOR ART
FIG. 21 is a diagram schematically showing the construction of a traditionally used fitting room 1.

FIGS. 17 to 20 show the detailed construction of the portion where the curtains 44*a* and 44*b* are suspended from the tip ends of the beam members 51*a* and 51*b*. FIG. 17 shows the condition of the curtains 44*a* and 44*b* drawn together to close the entrance 42 as shown in FIG. 16, or the condition in which both tip ends of the curtains 44*a* and 44*b* close. FIG. 18 shows the condition shortly before the condition of FIG. 17 is achieved. FIG. 19 shows the condition shortly before the condition of FIG. 18 is achieved. FIG. 20 shows the construction of the tip end portions with the curtains 44*a* and 44*b* removed from them.

As shown in FIGS. 17 to 19, hooks 71*a* for suspending the respective curtains 44*a* and 44*b* at their convex folded edges are provided at the tip ends of the respective beam members 51*a* and 51*b*. Hooks 71*b* for suspending the respective curtains 44*a* and 44*b* at their concave folded edges are supported by hinges 74*b* joining the respective beam members 51*a* and 51*b*, the guide plates 72*a* and 72*b* being supported by hinges 73*a* at the tip ends of the respective beam members 51*a* and 51*b*.

Of the beam members 51*a* and 51*b*, the foremost beam members 81*a* and 81*b* are respectively formed with roller grooves 82*a* and 82*b* extending lengthwise. Rollers 83*a* and 83*b* are inserted in the respective roller grooves 82*a* and 82*b*. The rollers 83*a* and 83*b* join together the base ends of links 84*a*, 85*a* and 84*b*, 85*b*, respectively. The tip ends of the links 84*a*, 85*a* and 84*b*, 85*b* are joined via pins to the second foremost guide plates 72*a* and 72*b* and the foremost guide plates 86*a* and 86*b*, respectively. A further guide plate 85*x* is connected to the tip end of the right-side guide plate 85*b*.

When the left and right curtains 44*a* and 44*b* are opened and closed by staggering the driving timings of the motors 55*a* and 55*b*, smooth open/close action can be achieved. In the case of using only one motor, smooth open/close action can also be achieved by mechanically staggering the timing by means of a cam.

According to the invention, the plurality of beam members are supported at their base ends by the guiding mechanism in such a manner that the beam members project outwardly relative to the dressing room in a substantially horizontal position. In this condition, the beam members suspend the curtain from their tip ends. The guiding mechanism guides the base ends of the beam members in such a manner that when the tip ends of the beam members are positioned above the entrance, the spacing at the tip ends between the adjacent beam members becomes wider than the spacing at the base ends between the adjacent beam members. When the tip ends are positioned displaced sideways from the position above the entrance, the spacing at the tip ends between the adjacent beam members becomes narrower than the spacing when the tip ends are positioned above the entrance. The curtain spreads outwardly relative to the entrance when closing over the entrance, and is retracted into one side of the entrance when the entrance is opened. As a result, when the curtain is closed, the space shielded from the outside by the curtain extends outwardly relative to the entrance, thus enlarging the space usable in the dressing room. When the curtain is opened, the space that was occupied by the curtain when it was drawn out can be used effectively for other purposes.

According to the invention, the dressing room can be easily installed as a single unit even in an unpartitioned space. The unitized dressing room, when installed, provides a wider usable space in the dressing room since the curtain spreads outwardly when the curtain is closed over the entrance and, when not in use, the space can be used for other purposes.

According to the invention, since the unitized dressing room can be moved by means of the moving member attached to the lower end thereof, the dressing room can be widely used in such applications as a movable, temporary dressing room or fitting room.

According to the invention, the curtain can be easily opened and closed by means of a motor.

Furthermore, according to the invention, the curtain suspension apparatus is constructed so that the guiding mechanism, while supporting the respective beam members in such a manner as to project outwardly relative to the opening in a substantially horizontal position, can guide the base ends of the plurality of beam members in such a manner that when their tip ends are positioned above the opening, the spacing at the tip ends between the adjacent beam members becomes wider than the spacing at the base ends between the adjacent beam members and, when their tip ends are positioned displaced sideways from the position above the opening, the spacing at the tip ends between the adjacent beam members becomes narrower than the spacing when the tip ends are positioned above the opening. The curtain suspended from the tip ends of the beam members spreads outwardly relative to the entrance when closing over the entrance, and is retracted into one side of the entrance when the entrance is opened. As a result, when the curtain is closed, the space shielded from the outside by the curtain extends outwardly relative to the entrance, thus enlarging the space usable in the dressing room. When the curtain is opened, the space that was occupied by the curtain when it was drawn out can be used effectively for other purposes.

According to the invention, the plurality of supporting members connected to the base ends of the respective beam members are guided by the guiding member in such a manner that the spreading angle between the respective beam members becomes larger in an area above the opening, and becomes smaller in an area displaced sideways from the area above the opening. Since the spreading angle between the beam members becomes larger in the area above the opening, the curtain suspended from the tip ends of the beam members can be spread out.

The invention claimed is:

1. A dressing room, comprising:

a vertically extending rigid wall structure forming a partially enclosed space and defining a vertically extending opening between opposite sides of said wall structure that forms an entrance to said rigid wall structure;

a plurality of beam members arranged at an upper end of said wall structure and having a curtain suspended therefrom; and a guiding mechanism that supports said plurality of beam members at base ends thereof for movement between a closed position of said curtain closing said entrance, in which position said curtain extends between said opposite sides of said wall structure, and an open position of said curtain in which said entrance is open, wherein:

said beam members project outwardly relative to said wall structure in a substantially horizontal position, and said guiding mechanism guides said base ends of said beam members such that when tip ends of said beam members are positioned above said entrance, spacing between said tip ends of adjacent ones of said beam members is wider than at said base ends, and such that when said tip ends are positioned to one side of said entrance, spacing at said tip ends of adjacent ones of said beam members is narrower than when positioned above said entrance;

wherein when said guiding mechanism guides said plurality of beam members to said closed position so that said curtain closes said entrance, a larger amount of horizontal area is occupied and enclosed by said wall structure and said curtain together than when said entrance is open in said open position of said curtain.

2. The dressing room of claim 1, wherein said wall structure comprises a sidewall member which forms sidewall surfaces excluding said entrance, and wherein said dressing room further comprises a holding member for holding said guiding mechanism at an upper part of said sidewall member.

3. The dressing room of claim 2, wherein said sidewall member comprises a moving member at a lower end thereof making the entirety of said dressing room movable.

4. The dressing room of claim 3, and further comprising a motor for moving said plurality of beam members such that said base ends of said beam members are guided by said guiding mechanism.

5. The dressing room of claim 2, and further comprising a motor for moving said plurality of beam members such that said base ends of said beam members are guided by said guiding mechanism.

6. The dressing room of claim 1, and further comprising a motor for moving said plurality of beam members such that said base ends of said beam members are guided by said guiding mechanism.

7. The dressing room of claim 1, wherein said base ends of said beam members are connected to respective supporting members, said guiding member guiding said supporting members such that a spreading angle between said beam members is larger in an area above said entrance than in an area displaced laterally of said area above said entrance.

8. A dressing room having an entrance capable of being opened and closed with a curtain, comprising:

a plurality of beam members, arranged in an upper part of the dressing room, for suspending the curtain from tip ends thereof; and a guiding mechanism for guiding base ends of the beam members, including:

a plurality of supporting members for supporting respective beam members of the plurality of beam members at the base ends thereof in such a manner that the beam members project outwardly relative to the dressing room in a substantially horizontal position, the plurality of supporting members being connected together in a chain; and a guiding member, along which the plurality of supporting member are movable, for guiding the plurality of supporting members in such a manner that when the tip ends are positioned above the entrance, spacing at the tip ends between the beam members adjacent to each other becomes wider than at the base ends and, when the tip ends are positioned displaced sideways from the position above the entrance, spacing at the tip ends between the adjacent beam members becomes narrower than the spacing when the tip ends are positioned above the entrance.

9. The dressing room of claim 8, further comprising:

a sidewall member which forms sidewall surfaces excluding the entrance; and a holding member for holding the guiding member at an upper part of the sidewall member.

10. The dressing room of claim 9, wherein the sidewall member is provided at a lower end thereof with a moving member that makes the entire structure of the dressing room movable.

11. The dressing room of claim 8, further comprising a motor for moving the plurality of supporting members along the guiding member.

12. A curtain suspension apparatus for drawing a curtain for closing an opening therewith, comprising:

a plurality of beam members for suspending the curtain from tip ends thereof; and a guiding mechanism for guiding base ends of the beam members, including:

a plurality of supporting members for supporting respective beam members of the plurality of beam members at the base ends thereof in such a manner that the beam members project outwardly relative to the opening in a substantially horizontal position, the plurality of supporting members being connected together in a chain; and a guiding member, along which the plurality of supporting member are movable, for guiding the plurality of supporting members in such a manner that when the tip ends are positioned above the opening, spacing at the tip ends between the beam members adjacent to each other becomes wider than at the base ends and, when the tip ends are positioned displaced sideways from the position above the opening, spacing at the tip ends between the adjacent beam members becomes narrower than the spacing when the tip ends are positioned above the opening.

13. The curtain suspension apparatus of claim 12, wherein the guiding member guides the plurality of supporting members in such a manner that a spreading angle between the beam members adjacent to each other becomes larger in an area above the opening, and becomes smaller in an area displaced sideways from the area above the opening.

14. The curtain suspension apparatus of claim 12, further comprising a motor for moving the plurality of supporting members along the guide member.

* * * * *